US010726721B2

(12) United States Patent
Cade

(10) Patent No.: US 10,726,721 B2
(45) Date of Patent: Jul. 28, 2020

(54) TRAFFIC CONTROL DEVICES, SYSTEMS, AND METHODS

(71) Applicant: RYG LIGHT, LLC, Solomons, MD (US)

(72) Inventor: Lowell Cade, Solomons, MD (US)

(73) Assignee: RYG LIGHT, LLC, Solomons, MD (US)

( * ) Notice: Subject to any disclaimer, the term of this patent is extended or adjusted under 35 U.S.C. 154(b) by 0 days.

(21) Appl. No.: 16/271,539

(22) Filed: Feb. 8, 2019

(65) Prior Publication Data

US 2019/0244520 A1 Aug. 8, 2019

Related U.S. Application Data

(60) Provisional application No. 62/628,155, filed on Feb. 8, 2018.

(51) Int. Cl.

| | |
|---|---|
| ***G08G 1/0955*** | (2006.01) |
| ***G08B 5/00*** | (2006.01) |
| ***E01F 9/615*** | (2016.01) |

(52) U.S. Cl.

CPC ..... *G08G 1/0955* (2013.01); *E01F 9/615* (2016.02); *G08B 5/006* (2013.01)

(58) Field of Classification Search

CPC ..... G08B 5/006; G08G 1/07; G08G 1/081; G08G 1/095; G09G 1/0955; G09F 15/0025; G09F 21/02; G09F 1/16922; G09F 1/1622; G09F 9/33; F21L 4/027; F21L 4/02; F21L 4/08; F21L 13/08; F21L 15/04; A41D 13/01; F21V 33/0076; F21V 23/04

See application file for complete search history.

(56) References Cited

U.S. PATENT DOCUMENTS

| | | | | |
|---|---|---|---|---|
| 2,751,581 A | | 6/1956 | Waltman | |
| 4,047,799 A | * | 9/1977 | Cross | F21L 15/04 359/516 |
| 4,847,589 A | * | 7/1989 | Dobbins | B60Q 1/52 340/326 |
| 4,876,811 A | * | 10/1989 | Peltz | G09F 21/02 40/586 |

(Continued)

FOREIGN PATENT DOCUMENTS

| | | |
|---|---|---|
| CN | 204087508 | 1/2015 |
| RU | 2652760 | 4/2018 |

*Primary Examiner* — Hoi C Lau

(74) *Attorney, Agent, or Firm* — Simplify Intellectual Property Law, PLLC; Mark H. Henderson, III

(57) ABSTRACT

A portable handheld traffic control device includes a lamp, a housing that encloses the lamp, and a handle. The handle attaches to a proximal (back) side of the housing and includes a control panel operable by a thumb of a hand grasping the handle. In a first (vehicle) mode, the lamp emits light on a distal (front) side of the housing in one of four colors: red, yellow, green, or white, when a respective button for the corresponding color is pressed. In a second (pedestrian) mode, pressing the red button causes the lamp to display a steady red upraised hand, pressing the yellow button causes the lamp to display a flashing red upraised hand, and pressing the green button causes the lamp to display a steady white walking person figure. A battery powers the lamp. The device includes a secondary display visible on the proximal (back) side of the device.

4 Claims, 17 Drawing Sheets

(56) References Cited

U.S. PATENT DOCUMENTS 5,081,568 A * 1/1992 Dong ..... F21L 4/02 362/184
5,185,637 A * 2/1993 Lewin ..... G01J 1/04 340/931
5,374,876 A * 12/1994 Horibata ..... G08B 5/006 315/178
5,440,464 A * 8/1995 Nowlin ..... G08B 5/006 340/321
5,598,654 A * 2/1997 Cowgill ..... B60Q 7/005 116/63 P
5,697,695 A * 12/1997 Lin ..... F21L 4/02 362/184
5,729,926 A * 3/1998 Cowgill ..... G09F 15/0025 116/173
5,870,110 A * 2/1999 Mallory ..... G09G 3/00 345/168
5,905,441 A * 5/1999 Klee ..... G08B 5/006 340/321
5,973,607 A * 10/1999 Munyon ..... G06F 1/1622 340/321
6,104,313 A 8/2000 Boyd, II
6,134,819 A 10/2000 McClain et al.
6,147,623 A * 11/2000 Rippen ..... G08G 1/0955 340/907
6,177,877 B1 * 1/2001 Munyon ..... G06F 1/1622 340/321
6,265,969 B1 7/2001 Shih
6,265,984 B1 * 7/2001 Molinaroli ..... A63H 33/40 340/815.4
6,722,771 B1 4/2004 Stephens
6,753,788 B1 * 6/2004 Munyon ..... G06F 1/1622 340/321
7,174,664 B2 * 2/2007 Spencer ..... G09F 9/33 40/442
7,259,691 B2 * 8/2007 Kimbrough, Jr. ..... A41D 13/01 340/907
7,388,515 B2 6/2008 Hill
7,470,036 B2 12/2008 Deighton et al.
7,746,247 B2 * 6/2010 Kimbrough, Jr. ..... A41D 13/01 340/907
D655,636 S * 3/2012 Mediavilla, III ..... D10/113.4
8,136,280 B2 * 3/2012 Spelman ..... G09F 21/02 40/541
8,144,030 B1 * 3/2012 Lipke ..... G08G 1/095 116/63 R
8,297,775 B2 * 10/2012 Wright ..... F21L 4/027 315/312
8,702,266 B1 * 4/2014 Montgomery ..... F21V 33/0076 362/184
8,887,423 B1 11/2014 Morgan
10,269,270 B2 * 4/2019 Coley ..... G09F 15/025
10,347,124 B1 * 7/2019 Grossberg ..... G08G 1/095
2003/0021121 A1 * 1/2003 Pederson ..... B60Q 1/2611 362/493
2004/0062039 A1 * 4/2004 Ahn ..... F21L 13/08 362/192
2005/0104741 A1 * 5/2005 Kimbrough, Jr. ..... A41D 13/01 340/815.45
2006/0092623 A1 * 5/2006 Irisawa ..... F21L 4/02 362/102
2007/0064411 A1 * 3/2007 Chang ..... A45B 3/04 362/102
2008/0062007 A1 * 3/2008 Kimbrough, Jr. ..... A41D 13/01 340/907
2008/0258933 A1 * 10/2008 Diba ..... G08G 1/095 340/907
2008/0281515 A1 11/2008 Ann et al.
2009/0021389 A1 1/2009 Entrup
2009/0261737 A1 * 10/2009 Wright ..... F21L 4/027 315/154
2009/0322563 A1 * 12/2009 Stadtmiller ..... G08G 1/081 340/909
2010/0283631 A1 * 11/2010 Bryant ..... G08G 1/07 340/916
2012/0216436 A1 8/2012 Adair
2012/0262304 A1 10/2012 Cripps
2013/0247435 A1 9/2013 Bacik
2014/0097970 A1 4/2014 Ethington
2015/0042492 A1 2/2015 Heacock
2016/0180752 A1 6/2016 Akwei et al.
2017/0082280 A1 3/2017 Reiser
2019/0019408 A1 * 1/2019 Beaulieu ..... G08G 1/0955
2019/0244520 A1 * 8/2019 Cade ..... G08B 5/006

* cited by examiner

FIG. 17 (Power Off)

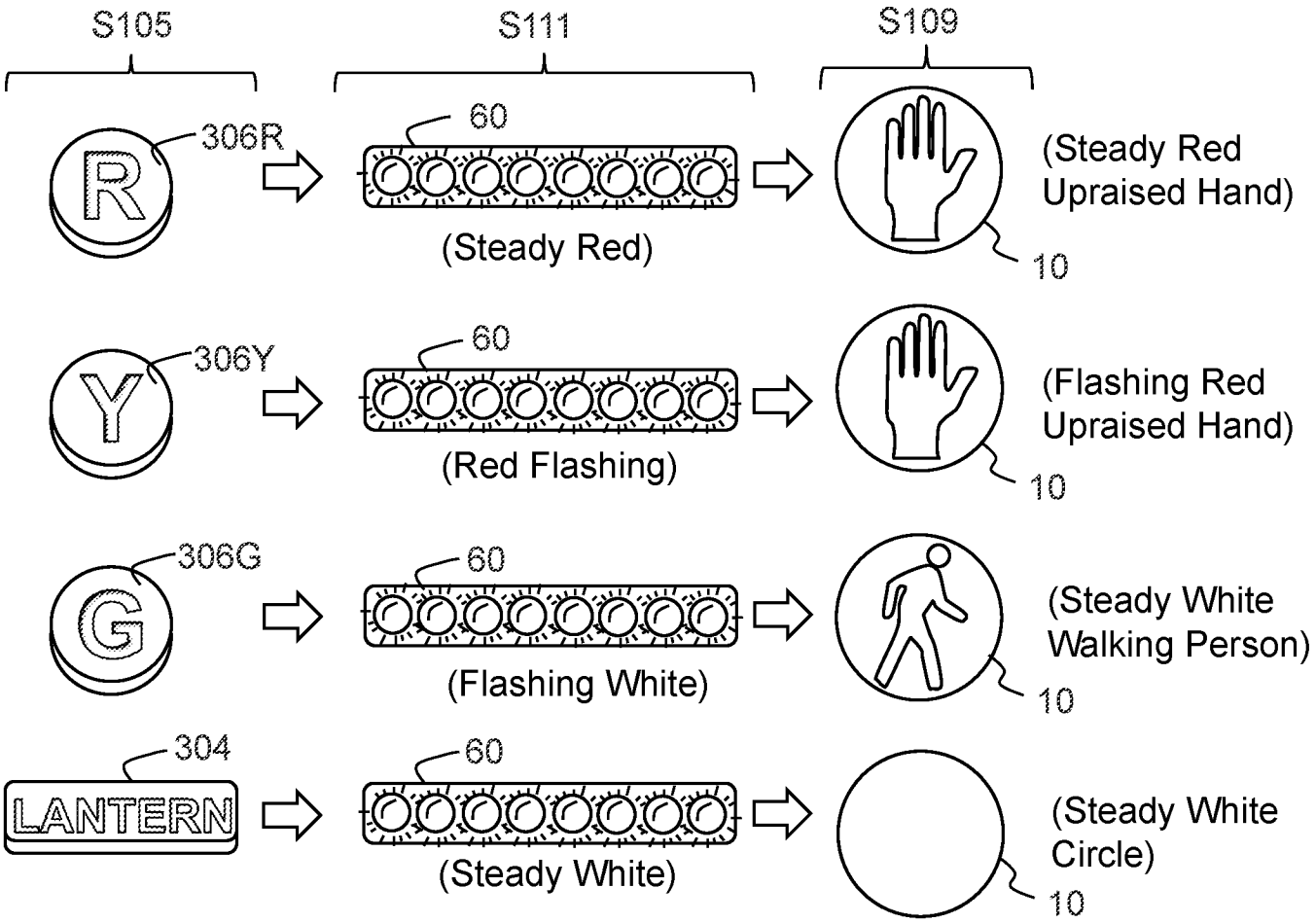
FIG. 19 (Pedestrian Mode)

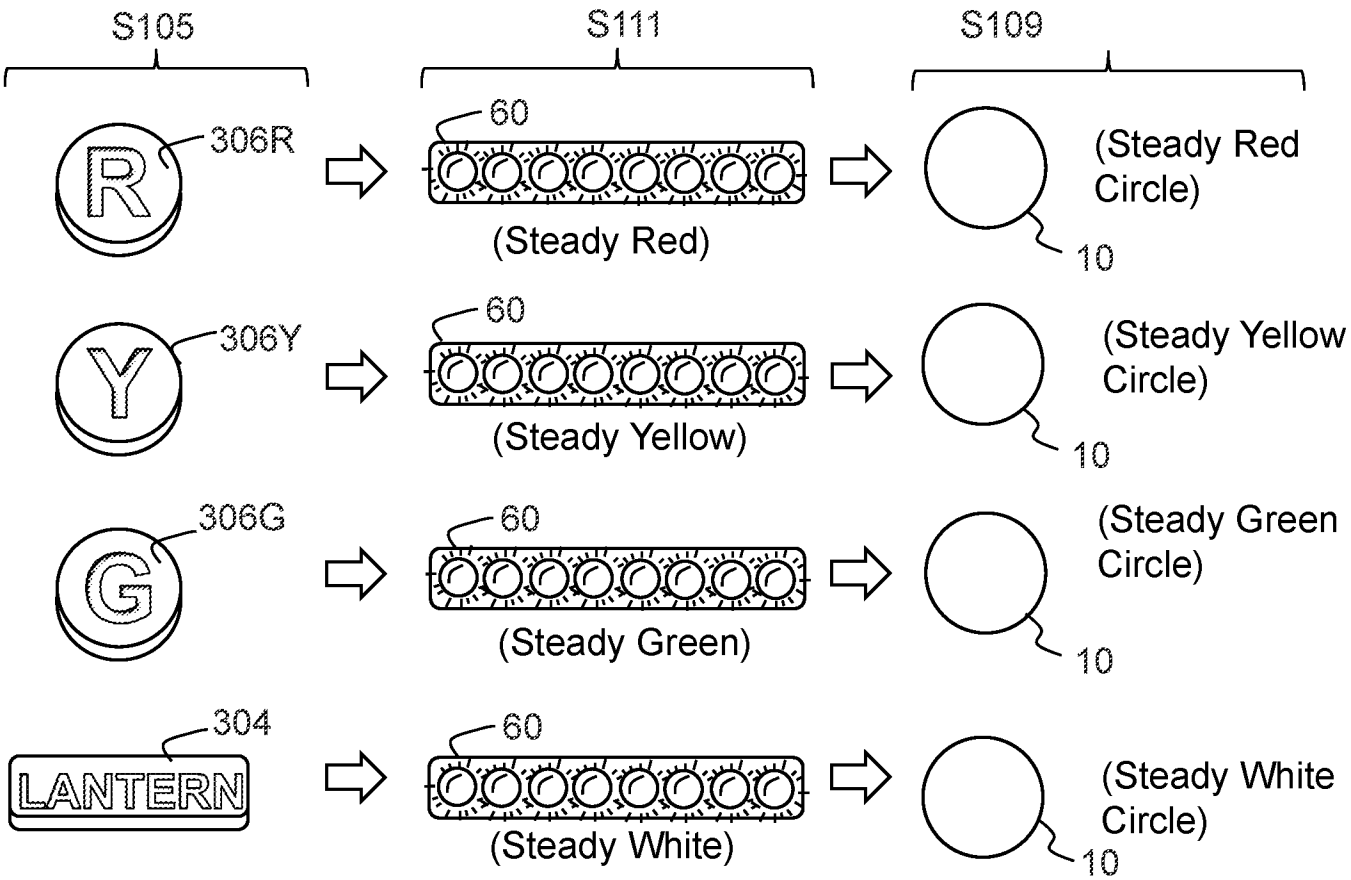
FIG. 20A (Vehicle Mode)

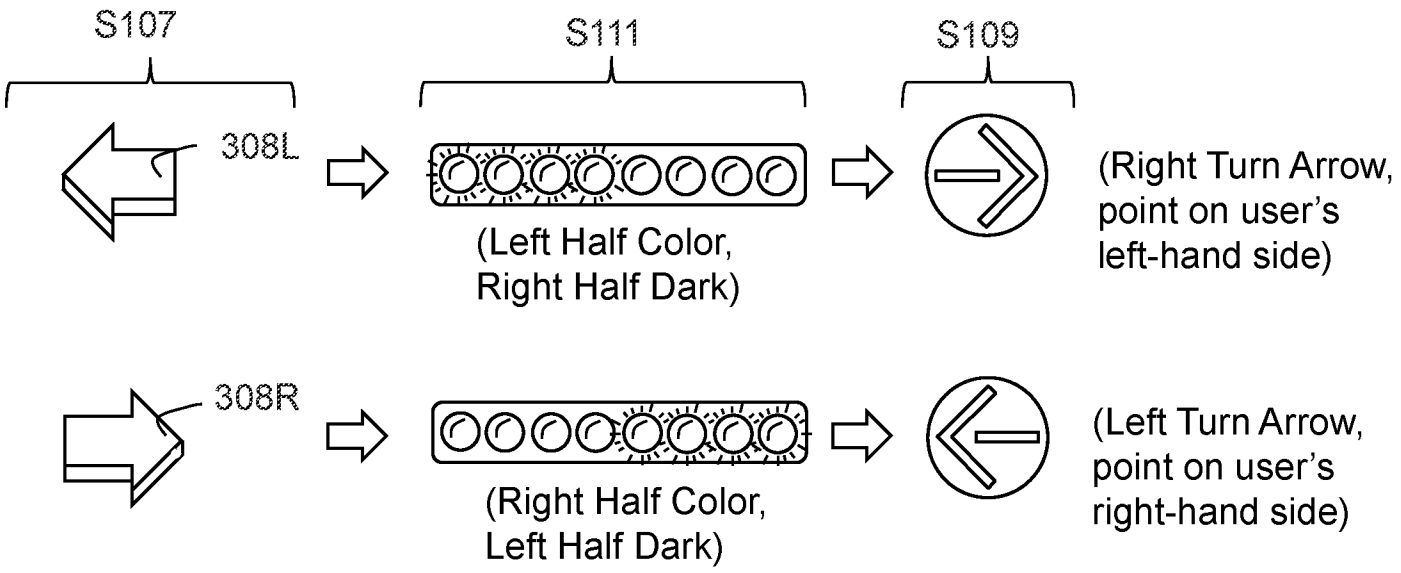
FIG. 20B (Vehicle Mode)

TRAFFIC CONTROL DEVICES, SYSTEMS, AND METHODS

CROSS REFERENCE TO RELATED APPLICATIONS

This application claims the benefit of U.S. provisional patent application Ser. No. 62/628,155, entitled TRAFFIC CONTROL DEVICES, SYSTEMS, AND METHODS, filed on Feb. 8, 2018, the entire contents of which are incorporated herein by reference.

BACKGROUND

Various devices, systems, and methods for controlling vehicle traffic are known. Various devices, systems, and methods for controlling pedestrian traffic are likewise known. In particular, vehicle and pedestrian traffic control signals (e.g., traffic lights and crosswalk signals) are known. For example, various standards, definitions, and specifications for such signals include those set forth in the "Manual on Uniform Traffic Control Devices" (MUTCD) of the United States Department of Transportation Federal Highway Administration. Other standards, definitions, and specifications include those set forth in the various publications of the Institute of Transportation Engineers (ITE), such as the "Vehicle Traffic Control Signal Heads" (VTCSH) standard, the "ITE LED Circular Signal Supplement" specification, the "VTCSH—Part 3: Light Emitting Diode (LED) Vehicle Arrow Signal Modules" specification, the "Pedestrian Traffic Control Signal Indications" (PTCSI) standard, and the "Pedestrian Traffic Control Signal Indicators-Light Emitting Diode (LED) Signal Modules" specification.

Dangerous conditions may arise when a traffic signal ceases to operate, such as may occur during a power outage. This may be especially so during inclement weather or at nighttime. In other situations, traffic signals are intentionally deactivated, such as during maintenance or during large-scale events (e.g., sporting events) to permit unusually large volumes of vehicle and/or pedestrian traffic to be accommodated. In these situations, and others, it may be desirable to have an alternative to permanently installed traffic signals.

BRIEF SUMMARY

Devices, systems, and methods for public and private traffic control are disclosed.

An embodiment may serve as an emergency traffic control system, providing visual communication anywhere needed.

A portable handheld traffic control device comprises a lamp; a housing that encloses the lamp; a handle attached to a proximal side of the housing, the handle including a control panel operable to control emission by the lamp of light on a distal side of the housing; and a signal mode selector switchable between a first mode in which manual buttons of the control panel are configured to cause the lamp to display a first set of signals, and a second mode in which the manual buttons are configured to cause the lamp to display a second set of signals different from the first set. The handle is attached to the proximal side of the housing by an attachment portion that extends from the housing to a grip portion adapted to be grasped by a hand. The control panel is situated at an intersection of the attachment portion and the grip portion. The control panel is operable to control operation of the lamp. The control panel includes at least three color buttons arrayed in a sequence on the control panel and at least two pattern buttons arrayed on the control panel, each of the three color buttons and the two pattern buttons being operable by a thumb of a hand when grasping the handle. In indentation in the proximal side of the housing accommodates the fingers, for example, the knuckles, of a user's hand. The portable handheld traffic control device is configured to communicate with a computer. The device includes a video camera fixed to the housing, and the computer has a user interface configured to display a video stream received from the camera. The computer has a software user interface (UI) including software control panel that mimics the shape, size, and arrangement of elements found on the control panel of the device.

Embodiments include a portable handheld traffic control light with three signals: red (stop), yellow (caution), and green (go). Some embodiments further include left and right turn signals. In some embodiments, the handheld traffic control light may emit a white light. In some embodiments, the signals are presentable alone or in combination to be emitted away from a surface of a lamp.

In some embodiments, the lamp has a circular profile. In some embodiments, the lamp is enclosed in a housing or case. In some embodiments, the housing includes a lens over the emitting side of the lamp housing, through which the lamp may emit light.

Some embodiments include a handle attached to the lamp housing. In some embodiments, the handle is attached to the lamp housing such that the lamp housing may be supported in use by a hand grasping the handle.

In some embodiments, the light is powered by one or more batteries. In some embodiments the batteries are rechargeable. In other embodiments, the batteries are disposable. In some embodiments, the handle encloses the batteries. In other embodiments, the batteries are distributed in other portions of the light. In still other embodiments, the batteries are distributed in the handle and in the housing. In still other embodiments, the batteries are distributed toward a bottom (gravity downward) end of the handheld light.

In some embodiments, the housing and/or the handle of the handheld traffic control light is made of a high impact plastic, combination of plastics, and/or combination of plastics and metal.

In some embodiments, the handheld traffic control light includes a sun shield above the lens.

In some embodiments, the handheld traffic control light includes a light source having at least one light-emitting diode (LED). Some embodiments include a plurality of LEDs arranged in an array. In some embodiments, the array includes one or more LEDs to emit light at a predetermined color, corresponding to a wavelength or range of wavelengths in the visible spectrum.

An embodiment includes a plurality of red light sources, a plurality of yellow light sources, and a plurality of green light sources. Other embodiments include a plurality of red light sources, green light sources, and blue light sources. In some embodiments, the intensity of red light, green light, and blue light may be varied to achieve one or more colors or shades, including white light. Other embodiments include at least one white light source.

A handheld light includes a handle attached to a rigid housing. The housing encloses a lamp. The handle is attached to a proximal surface of the housing. The handle includes a control panel having manual interface elements to permit a user to (1) turn the lamp on and off, (2) select a color for the lamp to emit, (3) select a pattern for the lamp to emit.

The manual interface elements include a switch to turn the lamp on and off; a lantern button to activate a white lamp color; a red button to activate a red lamp color; a yellow button to activate a yellow lamp color; a green button to activate a green lamp color; a left-hand arrow button to activate an arrow pointing toward the user's left-hand side; and a right-hand arrow button to activate an arrow pointing toward the user's right-hand side.

The control panel is integral to a surface angled away from a user's body when held in a user's hand, such that when held in a user's hand, the control panel is proximal to user's thumb on the hand that grasps the handle.

The handheld light is operable using a single hand, either right or left, without need of the other hand. The manual interface elements can be manipulated by the thumb of the hand that grasps the handle.

The handle includes ergonomic grip to facilitate comfort even during extended use. With the weight of batteries or other heavy components in, near, or below the handle, the center of gravity may be optimized such that mechanical moments (corresponding to torques) and resulting discomfort in a user's hand are minimal. For example, a police officer holding the handle for an extended period, as may be necessary during a power outage that disables a fixed roadside traffic signal.

A sun shield obstructs light that would otherwise be incident on the lens. The sun shield has an arcuate shape substantially concentric to the lens and extending away from the handle. The sun shield is made of a rugged plastic, plastic composite, metal, or the like.

Viewed from the front, the handheld light includes an array of light sources extending in a vertical direction and in a horizontal direction. The light sources are packed in a hexagonal "honeycomb" packing arrangement. The number of light sources is on the order of approximately 1,000. Accordingly, a degree of granularity in the individual points of light emitted is achieved sufficient to define various arrangements, including distinguishable left and right-hand arrows.

In an embodiment, light sources of differing colors are packed together in sufficiently close proximity to achieve dithering, i.e., mixing of colors when viewed from an appropriate distance from the light sources. In another embodiment, one or more of the light sources is capable of emitting light at variable wavelengths corresponding to discretely discernible colors, e.g., red, yellow, and green.

Advantageously, it is not necessary to manually place or remove filters to achieve the varying combinations of colors and/or patterns to be displayed by the light. In some embodiments, the light sources are controllable via a controller (e.g., an analog control board, a digital microcontroller, a computer etc.) in response to inputs received from the control panel. In some embodiments, each of the light sources is independently controllable via the controller. In other embodiments, the controller addresses a plurality of like light sources via a common signal path or bus.

The handheld light operates on 12-Volt direct current (DC) power. In other embodiments, lower or higher voltage electrical power is employed, for example, 1.5-Volt, 3-Volt, 6-Volt, 9-Volt, or 24-Volt DC power. In some embodiments, the handheld light is operable by alternating current (AC) power, such as 120-Volt or 240-Volt power. The handheld light may be operated by plug-in power to an external power source, e.g., a battery pack, an electrical plug comprised in a motor vehicle, a three-prong wall outlet or the like.

The handle attaches to a proximal side of a back panel of the lamp housing. In some embodiments, the handle is formed integrally with the back panel. In some embodiments, the handle is separable. The handheld light may be stored with the handle removed from the back panel. The handle may comprise the power supply and may include electrical contacts at a surface adjoining the back panel, the back panel having corresponding electrical contacts to form electrical connections at the corresponding contacts. If a handle presently in use to power the lamp is running low on power, a freshly charged replacement handle may be swapped-in to replace the depleted handle, while minimizing downtime for the handheld light.

Viewed from the side, the lamp housing includes an indentation to accommodate the fingers and/or knuckles of a user's hands as they grip the handle. This can also have the benefit of improving forward-backward balance of the light, such that the handheld light tends to remain balanced in the user's hand, rather than tipping forward or backward.

The rear panel includes attachment points to connect the rear panel to the proximal side of the housing. Each attachment point comprises a fastener, such as a machine screw, inserted through a corresponding hole into a threaded portion of the lamp housing. In some embodiments, the handle, the rear panel, the attachment points, and/or the housing includes weatherproofing, such as o-ring seals, overlapping flanges, or the like, to prevent or reduce ingress of moisture, dirt, or other substances that could degrade the electrical and/or electronic components housed in the lamp housing.

In an embodiment, one or both of the lamp housing and the handle are made by injection molding. In some embodiments, the housing and/or the handle is made of a black material. In other embodiments, the housing and/or the handle is made of a yellow material. In other embodiment, the housing and/or the handle is painted. The colors of material by which the housing and/or the handle may be constructed are not limited.

In an embodiment, the lamp comprises a high-density LED board, having on the order of greater than 10 LEDs per inch or even 100 LEDs per inch.

In various embodiments, the handheld light has an overall size of from 3 to 5 inches width by 3 to 5 inches height, by 3 to 5 inches depth. In other embodiments, the handheld lamp has an overall size of from 4 to 10 inches in each of width, height, and depth. In other embodiments, the handheld lamp has an overall size of from 9 to 24 inches in each of width, height, and depth. In some embodiments, the handheld lamp has an overall front-to-back depth of 3 to 8 inches, an overall height from top to bottom of 12 to 30 inches, and an overall width of from 8 to 24 inches. According to various embodiments, the handheld light may be substantially taller than it is wide, or vice-versa.

In some embodiments, the handheld lamp has a strobe light mode that can be activated from the control panel by pressing a strobe button. Alternatively, the strobe light mode is activated by a combination of buttons presses and/or duration of press on another button.

In some embodiments, the buttons, or other manual interface portions of the control panel include backlighting. The buttons can remain visible to a user operating the handheld light in a dark environment.

In some embodiments, a spacing between a gripping portion of the handle and the lamp housing is adjustable. More space for gloves in bad weather or for bigger or hands (or less spaced, for smaller hands) of different users are easily and reliably accommodated. In an embodiment, the spacing adjusts by sliding the handle fore or aft in relation to the lamp housing. In another embodiment, the spacing adjusts by rotating the handle about a threaded axial extension. In other embodiments, other adjustment means may be employed.

Some embodiments have only two color-selection buttons, corresponding to green and red. Where a yellow (caution) button is not present, in some embodiments, the handheld light controller is not configured to emit yellow light. In other embodiments lacking a yellow (caution) button, the handheld light controller is configured to emit yellow light only in conjunction with another button press. For example, pressing the red button may activate a routine by which a yellow light is first emitted for an interval, after which a red light is displayed.

In some embodiments, one or more controls is variously activated and deactivated by a single, repeated manipulation. For example, a green button may be pushed on and then pushed off.

In another embodiment, when manipulating the red button, a first push turns on the red light, and a second push turns causes the yellow light to blink a first predetermined number of times (e.g., 3 times) in a predetermined time interval, after which the red light blinks a second predetermined number of times (e.g., 2 times), after which the red light shines continuously. In some embodiments, the controller includes predefined programs or routines defining sequences or patterns for the handheld light to display. In some embodiments, the controller's programs can be removed, updated, or replaced in whole or in part. In some embodiments, the controller is programmed via an external computer, over a data cable, or wirelessly. In other embodiments, the controller is programmed via an onboard user interface.

In some embodiments, the handheld light includes a double arrow button to activate display of arrows pointing in two different directions simultaneously. In some embodiments, rather than a double arrow button, two arrow buttons are independently controllable, so that one or the other or both can be displayed simultaneously by manipulating the two separate buttons.

Some embodiments include a battery level indicator to show by visual, auditory, or other means, a state of charge of one or more batteries.

Some embodiments include reflective portions on one or more portions of the handheld lamp. In an embodiment, reflecting strips are disposed on side profiles of device. Thus, a user of the handheld lamp may be visible to oncoming motorists approaching from the user's side, notwithstanding that the beam of light emitted from handheld lamp is not shining directly toward such oncoming motorists.

In some embodiments, the handheld light is adjustable to display pedestrian signals, such as a person walking and/or a hand. In other embodiments, the handheld light is adjustable to display a timer or counter, with numerals or other characters displayed at intervals.

Some embodiments include a hand loop, through which a user's wrist may be inserted. The loop may aid the user in supporting the light, and/or prevent the light from falling in the event the user loses his or her grip while holding the device.

Some embodiments include a clamp by which the handheld lamp may be removably attached to a fixed point, such as a belt loop on a user's clothing, a rack in a vehicle or in a building, or the like. In an embodiment, the clamp is on an upper portion of the handheld light. In another embodiment, the clamp is on the handle. In another embodiment, the clamp is on a central portion of the handheld light.

In an embodiment, the handle and the housing are arranged at an angle relative to one another such that the handle forms at least one leg of a tripod and a contact point on a bottom portion of the housing forms another leg of the tripod, whereby the handheld light rests in a standing position on a horizontal surface. According to various embodiments, the horizontal surface may be the ground, may be comprised in an exterior body surface of a vehicle, such as the roof of a car, or another surface.

In some embodiments, the handle and housing are adjustable to form a stand. In other embodiments, one or both of the handle and the housing includes a rigid attachment point by which the handheld light may be fixed to a stand. In some embodiments, the stand is a tripod.

In some embodiments, the handheld light is controllable remotely, either by wired or wireless connection. A wireless connection may be a Bluetooth connection, Wi-Fi, a cellular connection, or the like. A wired or wireless connection may be formed as part of a larger network, or as part of a limited point-to-point connection. In the case of a wireless connection, the handheld light's various colors and/or patterns may be operated by a computer interface, e.g., by a user on a smartphone, tablet, personal computer, wearable device, or the like. In an embodiment, the remote connection is mediated by a web server comprised in the handheld light while the remote interface is displayed in a web browser. In another embodiment, the remote interface is displayed in a local application running on the user's device. The connection may be secured by requiring a username and password, biometrically, and/or by other means known or hereafter developed in the relevant fields.

In still other embodiments, the lamp body is powered separately from the handle and the handle communicates by wired or wireless connection with the lamp body. Thus, the lamp body may be positioned at a location distant from the user, e.g., outside a user's vehicle, while the user operates the lamp body, e.g., inside the user's vehicle.

Aspect 1. According to a first aspect, a portable handheld traffic control device comprises a lamp; a housing that encloses the lamp; a handle attached to a proximal side of the housing, the handle including a control panel operable to control emission by the lamp of light on a distal side of the housing; and a signal mode selector switchable between a first mode in which manual buttons of the control panel are configured to cause the lamp to display a first set of signals, and a second mode in which the manual buttons are configured to cause the lamp to display a second set of signals different from the first set.

1.1 In another aspect of Aspect 1, a first set of signals includes a first pattern, a second pattern different from the first pattern, and a third pattern different from the first and second patterns, wherein the manual buttons of the control panel include a first pattern button operable to cause the lamp to emit light in the first pattern and a second pattern button operable to cause the lamp to emit light in the second pattern.

1.1.1 In any of the above aspects, the manual buttons of the control panel may further include a first color button operable in the first mode to cause the lamp to emit light of a first color, and a second color button operable in the first mode to cause the lamp to emit light of a second color different from the first color.

1.1.1.1 In any of the above aspects, the first color button may be further operable in the second mode to cause the lamp to display a first signal of the second mode, the first signal of the second mode having at least one of a color different from the first color of the first mode, and a shape different from the first, second, and third patterns of the first mode.

1.1.1.1.1 In any of the above aspects, the second color button may be further operable in the second mode to cause the lamp to display a second signal of the second mode, the second signal of the second mode having at least one of a color different from the second color of the first mode, and a shape different from the first, second, and third patterns of the first mode.

1.1.2 In any of the above aspects, the control panel may further include a third color button operable in the first mode to cause the lamp to emit light of a third color different from the first and second colors.

1.1.2.1 In any of the above aspects, the third color button may be operable in the second mode to cause the lamp to display a third signal of the second mode, the third signal of the second mode having at least one of a color different from the third color of the first mode, and a shape different from the first, second, and third patterns of the first mode.

1.1.2.2 In any of the above aspects, the control panel further may include a fourth color button operable in the first mode to cause the lamp to emit light of a fourth color different from the first, second, and third colors.

1.1.3 In any of the above aspects, the first pattern may be a right turn arrow and the second pattern may be a left turn arrow.

1.1.3.1 In any of the above aspects, the third pattern may be a circle.

1.2 In any of the above aspects, the first set of signals may include a steady red color, a steady yellow color, and a steady green color.

1.2.1 In any of the above aspects, the first set of signals further may include a steady white color.

1.3 In any of the above aspects, the second set of signals may include a steady red color, a flashing red color, and a steady white color.

1.4 In any of the above aspects, the second set of signals may include a steady red upraised hand; a flashing red upraised hand; and a steady white walking person.

1.5 In any of the above aspects, the control panel may include the signal mode selector.

1.6 In any of the above aspects, the control panel may include a power switch operable to connect and disconnect a power supply to the device.

1.7 In any of the above aspects, the control panel may be operable by a thumb of a hand grasping the handle.

1.8 In any of the above aspects, the device may further include an indentation on the proximal side of the housing adapted to accommodate a finger or knuckle of a hand grasping the handle.

1.9 In any of the above aspects, the device may further include a feedback window on the proximal side of the housing, the feedback window being configured to display responses corresponding to signals displayed by the lamp.

1.9.1 In any of the above aspects, the feedback window may include a plurality of light sources arrayed between left and right-hand sides of the distal side of the housing 1.9.2 In any of the above aspects, the light sources may include light-emitting diodes.

1.10 In any of the above aspects, the device may further comprise a video camera fixed to the housing.

1.10.1 In any of the above aspects, the device may further include a controller configured to capture a video stream received by the video camera.

1.10.1.1 In any of the above aspects, the controller may be further configured to encode the video stream and to communicate the video stream to a remote device by a network connection.

Aspect 2. According to a second aspect, which may be combined with any of the above aspects, a non-transitory computer-readable medium may store instructions to configure a controller to perform a method comprising: receiving a change in a state of a signal mode selector of a traffic control device, and when the signal mode selector state changes, updating a state of a lamp of the traffic control device and updating a state of a feedback window of the traffic control device; receiving a change in a state of a color selector of the traffic control device, and when the color state changes, updating a state of the lamp and updating a state of the feedback window; receiving a change in a state of a pattern selector of the traffic control device, and when the pattern state changes, updating a state of the lamp and updating the state of the feedback window.

Aspect 3. According to a third aspect, which may be combined with any of the above aspects, a system may comprise a portable handheld traffic control device in communication with a computer, the traffic control device having a camera, the computer having a user interface to display a video stream received from the camera.

3.1 In any of the above aspects, the computer may be a mobile device.

3.2 In any of the above aspects, the user interface may include a touchscreen.

3.3 In any of the above aspects, the user interface may include a control panel having a signal mode selector, a first color button, a second color button, a third color button, a first pattern button, and a second pattern button, the signal mode selector located toward a bottom of the control panel, the first, second, and third color buttons arrayed above the signal mode selector and extending between right and left-hand sides of the control panel, and the first and second pattern buttons arrayed above the first, second, and third color buttons and extending between right and left-hand sides of the control panel.

3.3.1 In any of the above aspects, the control panel further may comprise a fourth color button located above the signal mode selector and below the first, second, and third color buttons.

3.3.2 In any of the above aspects, the control panel further may comprise a third pattern button located between the first and second pattern buttons.

Aspect 4. According to a fourth aspect, which may be combined with any of the above aspects, a portable handheld traffic control device may comprise: a lamp; a housing that encloses the lamp; a handle attached to a proximal side of the housing, the handle including a control panel operable to control emission by the lamp of light on a distal side of the housing; and an indentation on the proximal side of the housing adapted to accommodate a finger or knuckle of a hand when grasping the handle.

4.1 In any of the above aspects, the control panel further may be integral to a surface angled toward the proximal side of the housing.

4.2 In any of the above aspects, the center of gravity of the device may be below a top edge of the hand when grasping the handle.

4.3 In any of the above aspects, the device may comprise a battery compartment located below the center of gravity of the device.

Aspect 5. According to another aspect of the technology, which may be combined with any of the above aspects, a portable handheld traffic control device may include a mount point adapted for mounting the device on a tripod.

BRIEF DESCRIPTION OF DRAWINGS

The present technology is illustrated by way of example, and not by way of limitation, in the figures of the accompanying drawings, in which like reference numerals refer to similar elements, wherein:

FIG. 19 shows aspects of a method according to an embodiment;

FIG. 20A shows aspects of a method according to an embodiment;

FIG. 20B shows a system according to an embodiment;

DETAILED DESCRIPTION OF EMBODIMENTS

Figure 1:
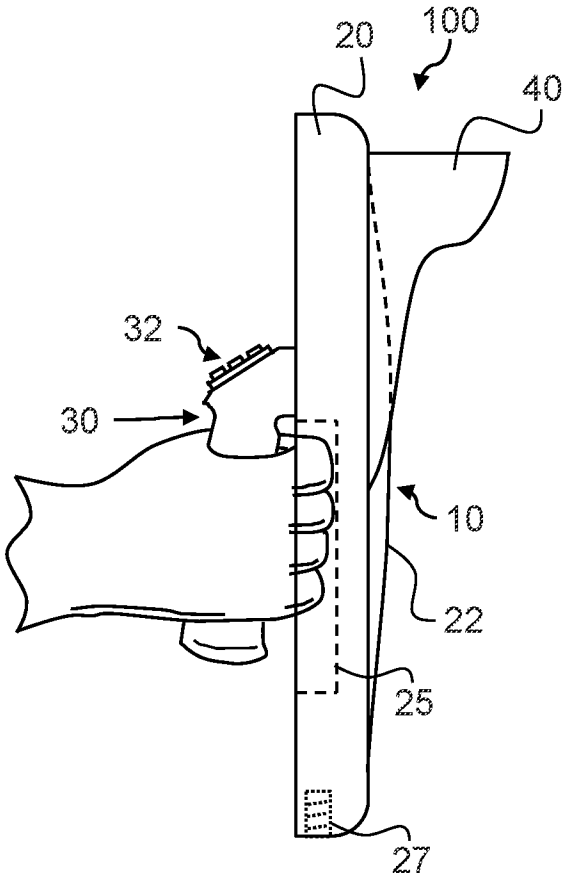
FIG. 1 shows a side view of a device in use according to an embodiment.

FIG. 1 shows a side view of a portable handheld traffic control device 100 in use according to a first embodiment. Embodiments include a portable handheld traffic control device 100 having three signal colors: red (stop), yellow (caution), and green (go). Some embodiments further include left and right turn signals. In some embodiments, the handheld traffic control device 100 also may emit white light. In some embodiments, the signals are presentable alone or in combination to be emitted away from a surface of a lamp 10.

The handheld traffic control device 100 includes the lamp 10. In some embodiments, the lamp 10 is enclosed in a housing 20. In some embodiments, the housing 20 includes a lens 22 over an emitting side of the housing 10, through which the lamp 10 shines when illuminated. Other embodiments omit the lens 22.

Figure 2:
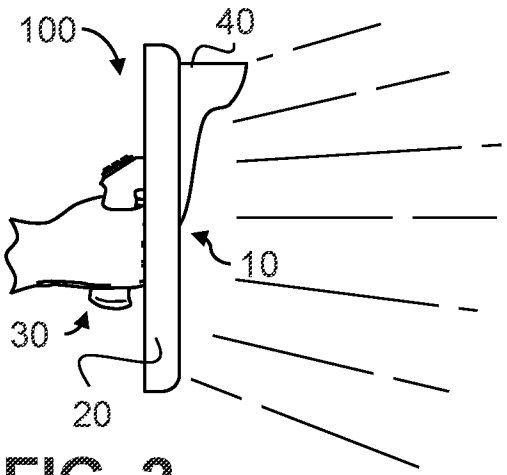
FIG. 2 shows a side view of a device in use according to an embodiment.

FIG. 2 shows a side view of the portable handheld traffic control device 100 in use. FIG. 2 shows light being emitted from the lamp 10. In FIG. 2 the lens 22 is omitted. Still other embodiments include multiple lenses. For example, where multiple light sources are provided, each may include its own lens.

Figure 3:
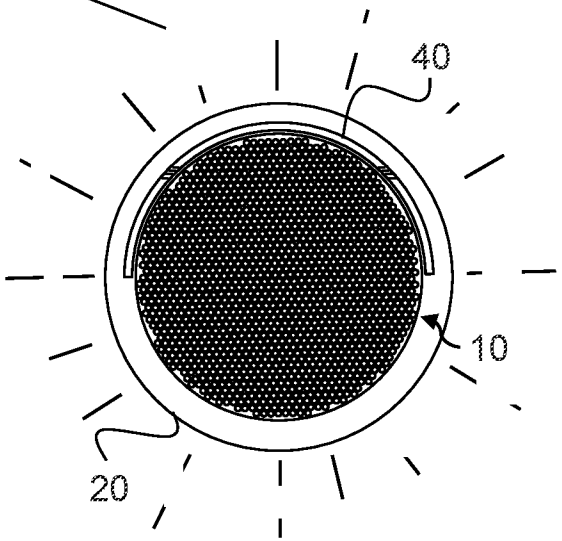
FIG. 3 shows a front view of a device according to an embodiment.

FIG. 3 shows a front view of the portable handheld traffic control device 100 in use. FIG. 3 shows light being emitted from the lamp 10. In some embodiments, the lamp 10 has a circular profile. In other embodiments, the lamp 10 has a profile of a different shape, such as a square, a rectangle, a triangle, or an octagon. In an embodiment, the lamp 10 has a size and shape corresponding to a defined standard. For example, in some embodiments, the lamp 10 illuminates a circular shape having a diameter of 12 inches. In some embodiments, the lamp 10 has a diameter from 11.5 inches to 13 inches.

The handheld traffic control device 100 includes a handle 30 attached to the housing 10. In some embodiments, the handle 30 is attached to the lamp housing 20 such that the lamp housing 20 may be supported in use by a hand grasping the handle 30. In an embodiment, a control panel 32 is disposed on or near the handle 30.

In some embodiments, the handheld traffic control device 100 includes a sun shield 40 above the lamp 10 and/or above the lens 22. The sun shield 40 obstructs light that would otherwise be incident on the lamp 10 and/or the lens 22. The sun shield 40 has an arcuate shape substantially concentric to the lens 22 and extending away from the handle 30. The sun shield 40 in certain non-limiting embodiments is made of a rugged plastic, plastic composite, metal, or the like. In an embodiment, one or both of the lamp housing 20 and the handle 30 are made by injection molding. In some embodiments, the housing 20 and/or the handle 30 is made of a black material, a yellow material, or is painted. The colors of material by which the housing 20 and/or the handle 30 may be constructed are not limited.

Figure 4:
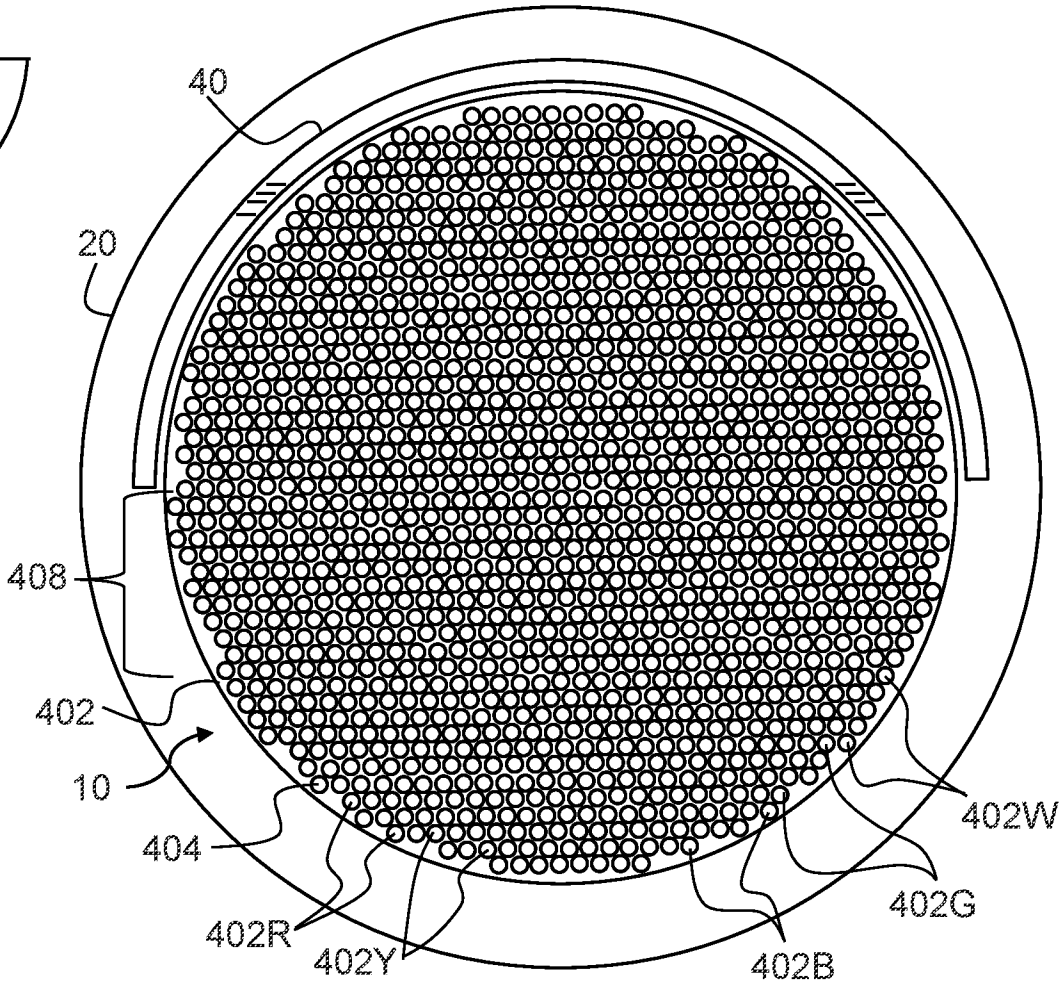
FIG. 4 shows a front view of a device according to an embodiment.

FIG. 4 shows a front view of the portable handheld traffic control device 100. In some embodiments, the lamp 10 of the handheld traffic control device 100 includes a light source 402 having at least one light-emitting diode (LED) 404. Some embodiments include a plurality of the LEDs 404 arranged in an array 408. In some embodiments, the array 408 includes one or more of the LEDs 404 adapted to emit light at a predetermined color, corresponding to a wavelength or range of wavelengths in the visible spectrum. In some embodiments, the lamp 10 includes a light source 402 other than, or in addition to, the LED 404, for example one or more of an incandescent bulb, a halogen bulb, a fluorescent bulb, or an organic light-emitting diode (OLED), without limitation. Light sources 402 according to various embodiments include individual lenses. For example, an LED 404 may have a lens formed integrally around a diode, the lens being made of a resin or thermoplastic, for example.

An embodiment includes a lamp 10 having a plurality of red light sources 402R, a plurality of yellow light sources 402Y, and a plurality of green light sources 402G. Other embodiments include a plurality of the red light sources 402R, a plurality of the green light sources 402G, and a plurality of blue light sources 402B. In some embodiments, the intensity of red light, green light, and blue light may be varied to achieve one or more colors or shades, including white light. Other embodiments include at least one white light source 402W.

In some embodiments, a signal having a red color is achieved by illuminating only the red light sources 402R. In some embodiments, a signal having a yellow color is achieved by illuminating only the yellow light sources 402Y. In some embodiments, a signal having a green color is achieved by illuminating only the green light sources 402G. In some embodiments, a signal having a blue color is achieved by illuminating only the blue light sources 402B. In some embodiments, a signal having a white color is achieved by illuminating only the white light sources 402W. In some embodiments, a signal having any of various colors within a range of colors is achieved by illuminating two or more of the light sources 402R, 402Y, 402G, 402B, and 402W.

Viewed from the front (i.e., the light-emitting side), the handheld device 100 includes the array 408 of the light sources 402 extending in at least two dimensions, for example, in a vertical direction and in a horizontal direction. The light sources 402 are packed in a hexagonal "honeycomb" packing arrangement. In other embodiments, other arrangements are used, for example, rectangular. The number of the light sources 402 is on the order of approximately 1,000. Accordingly, a degree of granularity in the individual points of light emitted is achieved sufficient to define various arrangements, including distinguishable left and right-hand arrows, an upraised hand, and/or a walking person, for example. Other embodiments use more of the lights sources 402. Still other embodiments use fewer of the light sources 402.

In an embodiment, the light sources 402 of differing colors are packed together in sufficiently close proximity to achieve dithering, i.e., mixing of colors when viewed from an appropriate distance from the light sources 402. In another embodiment, one or more of the light sources 402 is capable of emitting light at variable wavelengths corresponding to discretely discernible colors, e.g., red, yellow, and green.

Advantageously, according to some embodiments, it is not necessary to manually place or remove filters to achieve the varying combinations of colors and/or patterns to be displayed by the handheld device 100. In some embodiments, the light sources 402 are controllable via a controller 120 (e.g., an analog control board, a digital microcontroller, a computer, etc.) in response to inputs received from the control panel 32. (See FIG. 12.) In some embodiments, each of the light sources 402 is independently controllable via the controller 120. In other embodiments, the controller 120 addresses a plurality of like light sources via a common signal path or bus. In an embodiment, the lamp 10 comprises a high-density LED board, having on the order of greater than 10 LEDs per inch or even 100 LEDs per inch.

Figure 5:
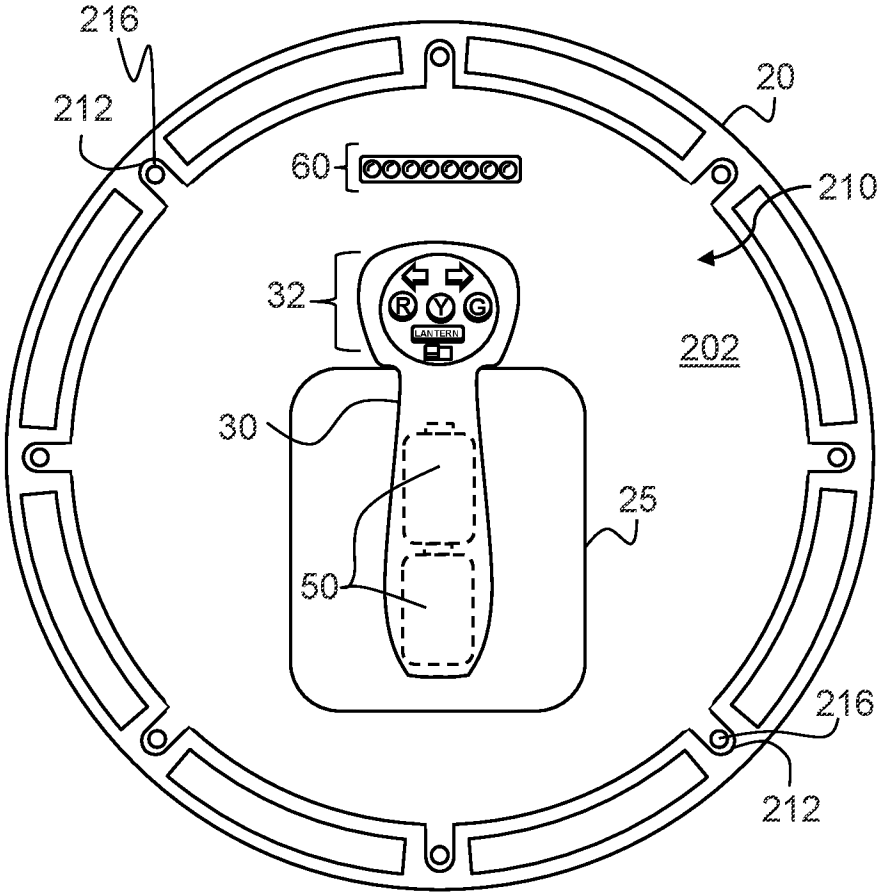
FIG. 5 shows a back view of the device of FIG. 4.

FIG. 5 shows a back view of the device 100 of FIG. 4, according to an embodiment. The portable handheld traffic control device 100 is powered by a power supply 500, which may include one or more batteries 50. In some embodiments, the battery 50 includes at least two battery cells connected in series. In other embodiments the battery 50 includes at least two battery cells connected in parallel. In some embodiments the battery 50 is rechargeable. In other embodiments, the battery 50 is disposable. In some embodiments, the handle 30 encloses the battery 50. In other embodiments, the batteries 50 are distributed in other portions of the device 100. In still other embodiments, the batteries 50 are distributed in the handle 30 and in the housing 20. In still other embodiments, the batteries 50 are distributed toward a bottom (gravity downward) end of the handheld device 100.

In one embodiment, the handheld device 100 operates on 12-Volt direct current (DC) power. In other embodiments, lower or higher voltage electrical power is employed, for example, 1.5-Volt, 3-Volt, 6-Volt, 9-Volt, or 24-Volt DC power. In some embodiments, the handheld device 100 is operable by alternating current (AC) power, such as 120-Volt or 240-Volt power. The handheld device 100 may be powered by plug-in power from an external power source, e.g., an external battery pack, an electrical plug comprised in a motor vehicle, a three-prong wall outlet, or the like.

In some embodiments, the housing 20 and/or the handle 30 of the handheld traffic control device 100 is/are made of a high impact plastic, combination of plastics, and/or combination of plastics and metal. In an embodiment, the back panel 210 includes attachment points 212 to connect the back panel 210 to the proximal side of the housing 20. Each attachment point 212 comprises a fastener 216, such as a machine screw, a clip, or the like, inserted through a corresponding hole into a mating portion (such as a threaded portion) of the lamp housing 20. In some embodiments, the handle 30, the back panel 210, the attachment points 212, and/or the housing 20 includes weatherproofing, such as O-ring seals, overlapping flanges, or the like, to prevent or reduce ingress of moisture, dirt, or other substances that could degrade the electrical and/or electronic components housed in the lamp housing.

The handheld device 100 of the embodiment shown in FIG. 5 includes the handle 30 attached to the rigid housing 20. The housing 20 encloses the lamp 10. The handle 30 is attached to a proximal side 202 of the housing 20. The handle 30 includes a control panel 32.

The handheld device 100 of the embodiment shown in FIG. 5 includes a feedback window 60, by which the device 100 communicates to the user information regarding the active state of the lamp 10. The feedback window 60 is an example of a secondary display visible on the proximal (back) side of the device 100. The feedback window 60 provides a simplified representation of whatever signal the lamp 10 is currently displaying. As the user manipulates the control panel 32, changes in the state of the lamp 10 are shown by corresponding changes in the state of the feedback window 60.

Figure 6:
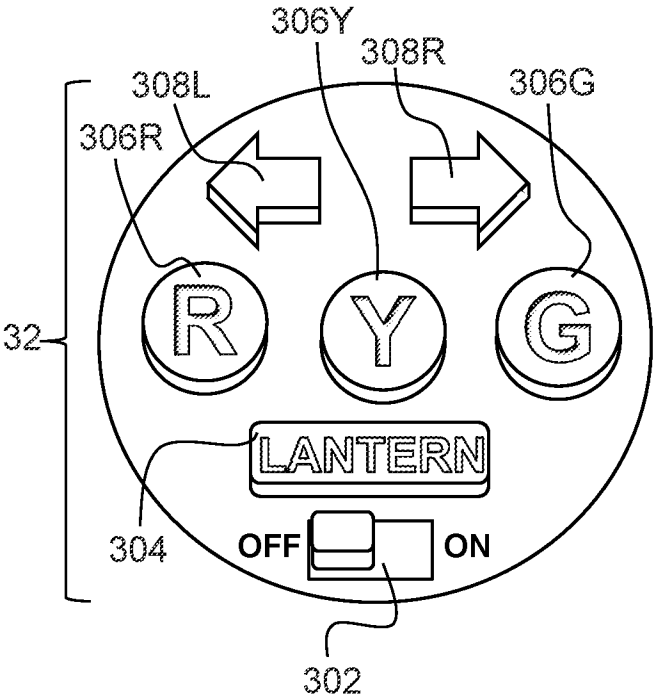
FIG. 6 shows a detailed view of the device of FIGS. 4 and 5.

FIG. 6 shows a detailed view of the control panel 32 of shown in FIG. 5 according to one embodiment. The control panel 32 has manual interface elements (302, 304, 306, 308, etc.) to permit a user to: (1) turn the lamp 10 on and off, (2) select a color for the lamp 10 to emit, and (3) select a pattern for the lamp 10 to emit.

The manual interface elements include a power switch 302 to turn the lamp 10 on and off; a lantern button 304 to activate a white lamp color; a red button 306R to activate a red lamp color; a yellow button 306Y to activate a yellow lamp color; a green button 306G to activate a green lamp color; a left-hand arrow button 308L to activate an arrow pointing away from the user on the user's left-hand side when the user's hand grasps the handle 30 with the hand in front of the user; and a right-hand arrow button 308R to activate an arrow pointing away from the user on the user's right-hand side when the user's hand grasps the handle 30 with the hand in front of the user.

The control panel 32 according to an embodiment is integral to a surface angled away from the user's body when held in the user's hand, such that when held in the user's hand, the control panel 32 is proximal to the user's thumb on the hand that grasps the handle 30. The handheld device 100 is operable using a single hand, either right or left, without need of the other hand. Of course, the device 100 also can be operated with both hands. The manual interface elements (302, 304, 306, 308, etc.) can be manipulated by the thumb of the hand that grasps the handle 30.

In various embodiments, the control panel 32 has a substantially circular shape having a diameter of 2 inches; from 0.75 to 1.5 inches; from 1 to 2.25 inches; or from 1.75 to 3 inches, for example. In other embodiments, the control panel 32 has another shape, for example, oblong, rectangle, triangle, octagon, etc. In various embodiment, each of the red, yellow, and green color buttons (306R, 306Y, 306G) has a substantially circular shape having a diameter of 0.33 inches; from 0.2 to 0.3 inches; from 0.25 to 0.4 inches; or from 0.35 to 0.5 inches. In other embodiments, one or more of the red, yellow, and green color buttons (306R, 306Y, 306G) has another shape, for example, oblong, rectangle, triangle, octagon, etc. In various embodiments, each of left and right-hand arrow buttons (308L, 308R) has a shape of an arrow having a dimension in height and/or width of 0.33 inches; from 0.2 to 0.3 inches; from 0.25 to 0.4 inches; or from 0.35 to 0.5 inches. In other embodiments, one or more of the left and right-hand arrow buttons (308L, 308R) has another shape, for example, oblong, rectangle, triangle, octagon, etc. The red, yellow, and green color buttons (306R, 306Y, 306G) and the lantern button 304 are examples of color selectors. The left and right-hand arrow buttons (308L, 308R) are examples of pattern selectors. Other embodiments of a color selector include one or more additional manual interface elements. Other embodiments of a pattern selector include one or more additional manual interface elements.

Figure 7:
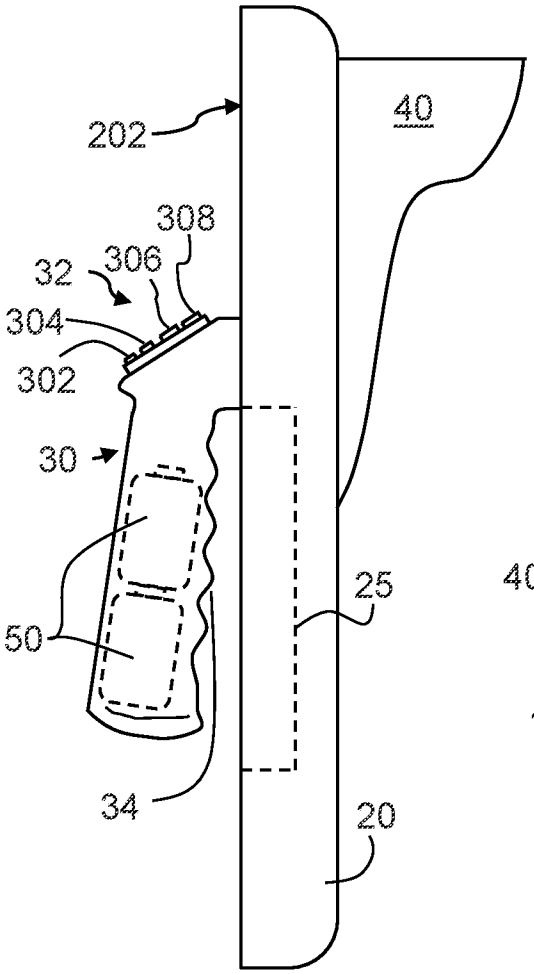
FIG. 7 shows a side view of a device according to FIGS. 4-6.

FIG. 7 shows a side view of the device 100 according to an embodiment. The handle 30 attaches to the proximal side 202 of a back panel 210 of the lamp housing 20. In some embodiments, the handle 30 is formed integrally with the back panel 210. In some embodiments, the handle 30 is separable.

Viewed from the side (see, e.g., FIGS. 1, 2, and 7), the lamp housing 20 includes an indentation 25 to accommodate the fingers and/or knuckles of a user's hand as it grips the handle 30. This can also have the benefit of improving forward-backward balance of the handheld device 100, such that the device 100 tends to remain balanced in the user's hand, rather than tipping forward or backward. The indentation 25 is also shown in FIG. 5.

In some embodiments, the center of gravity of the device 100 is below a top edge of the user's hand when grasping the handle 30. With the weight of the batteries 50 or other heavy components in, near, or below the handle 30 itself, the center of gravity of the device 100 may be optimized such that mechanical moments (corresponding to torques) and resulting discomfort in a user's hand are minimal. In an embodiment, the handle 30 includes an ergonomic grip portion 34 to facilitate comfort even during extended use. For example, a police officer holding the handle 30 for an extended period, as may be necessary during a power outage that disables a fixed roadside traffic signal, may benefit from improved ergonomics.

Figure 8:
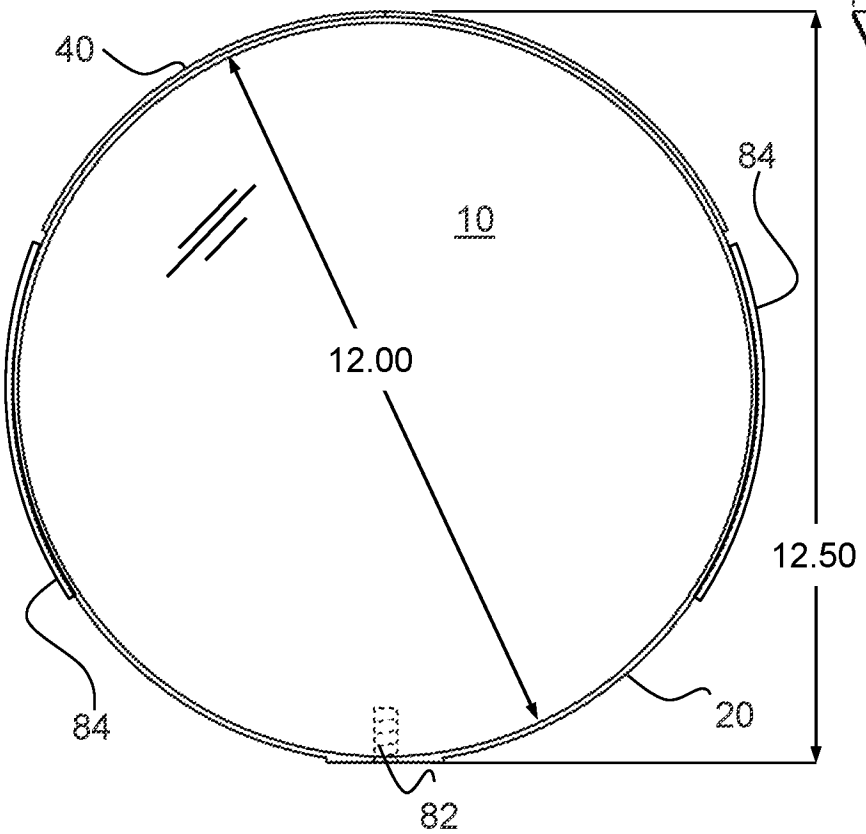
FIG. 8 shows a front view of a device according to an embodiment.

FIG. 8 shows a front view of another embodiment of the device 100. The lamp 10 has a diameter of 12 inches. The lamp housing has a height of 12.5 inches. The lamp housing 20 includes a tripod mount 27, shown in dashed lines. The tripod mount 27 extends vertically into the lamp housing 20 to permit attachment of the device 100 to a tripod, or another fixed mounting point, in substantially like manner as a photographic camera may be mounted on a tripod.

In some embodiments, the device 100 includes a reflective portion 84 on one or more outward-facing edge portions of the lamp housing 20. The reflective portions 84 on left and right sides of the device 100 may provide an additional safety mechanism by providing enhanced visibility for a user operating the device 100. For example, when a vehicle such as an automobile approaches the user in the dark from a side perpendicular to a direction in which the lamp 10 is facing, an operator of the automobile may be substantially unable to see the lamp 10, much less the user. However, light emitted from the automobile's headlights may be reflected off the reflective portions 84, thereby alerting the automobile operator to the presence of the device 100 and user ahead. In some embodiments, the reflective portion 84 includes a reflective film. In some embodiments, the reflective portion 84 includes metallic, glass, and/or plastic elements to reflect incident light.

Figure 9:
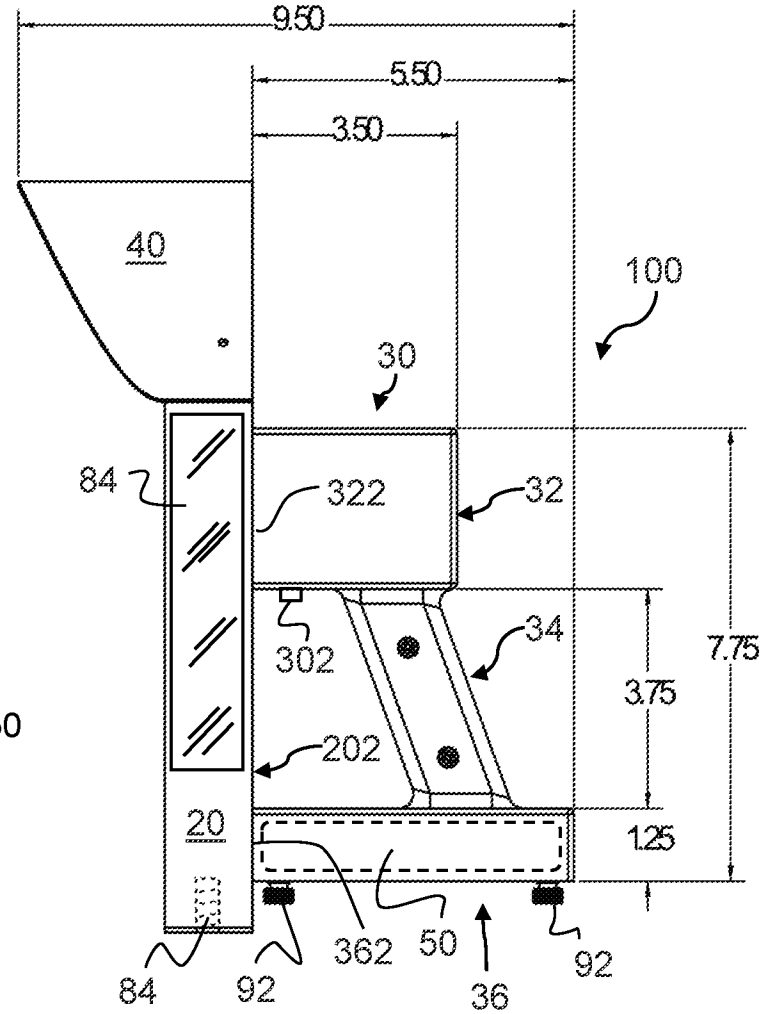
FIG. 9 shows a side view of the device of FIG. 8.

FIG. 9 shows a side view of the device 100 shown in FIG. 8. The device 100 includes the handle 30, the control panel 32, and a battery compartment 36. The battery compartment 36 has a shape and size adapted to receive a replaceable battery 50. Thumb screws 92 thread into holes in the battery compartment 36 to permit the battery compartment 36 to be opened manually to swap the battery 50 for a replacement battery 50.

The handle 30 further includes a primary attachment portion 322 and a secondary attachment portion 362. The primary attachment portion 322 extends from an upper end of the handle 30 to the proximal side 202 of the lamp housing 20. The secondary attachment portion 362 extends from a lower end of the handle 30 to the proximal side 202 of the lamp housing 20. In one embodiment, the primary attachment portion 322 and/or the secondary attachment portion 362 are formed integrally in one piece with the proximal side 202. In other embodiments, fasteners or other engagement means are provided to fix the primary attachment portion 322 and/or the secondary attachment portion 362 to the proximal side 202.

In various embodiments, the handle 30, from the bottom of the battery compartment 36 to top of the primary attachment portion 322 measures 7.75 inches; from 6 to 9 inches; or from 8 to 13 inches.

In various embodiments, the primary attachment portion 322, from the proximal side 202 to the control panel 32, measures 3.5 inches; from 2 to 5 inches; or from 4 to 6 inches.

In various embodiments, the grip portion 34 has a height measuring 3.75 inches; from 2.75 to 4.5 inches; or from 4 to 8 inches.

In various embodiments, the batter compartment 36 has a length extending away from the proximal side 202 measuring 5.5 inches; from 4 to 6.5 inches; or from 6 to 9 inches.

In various embodiments, the device 100 has an overall length extending from a front edge of the sun shield 40 to a rear edge of the handle 30 measuring 9.5 inches; from 5 to 11 inches; or from 10 to 14 inches.

In various embodiments, the handheld light has an overall size of from 3 to 5 inches width by 3 to 5 inches height, by 3 to 5 inches depth. In other embodiments, the handheld lamp has an overall size of from 4 to 10 inches in each of width, height, and depth. In other embodiments, the handheld lamp has an overall size of from 9 to 24 inches in each of width, height, and depth. In some embodiments, the handheld lamp has an overall front-to-back depth of 3 to 8 inches, an overall height from top to bottom of 12 to 30 inches, and an overall width of from 8 to 24 inches. According to various embodiments, the handheld light may be substantially taller than it is wide, or vice-versa.

Figure 10:
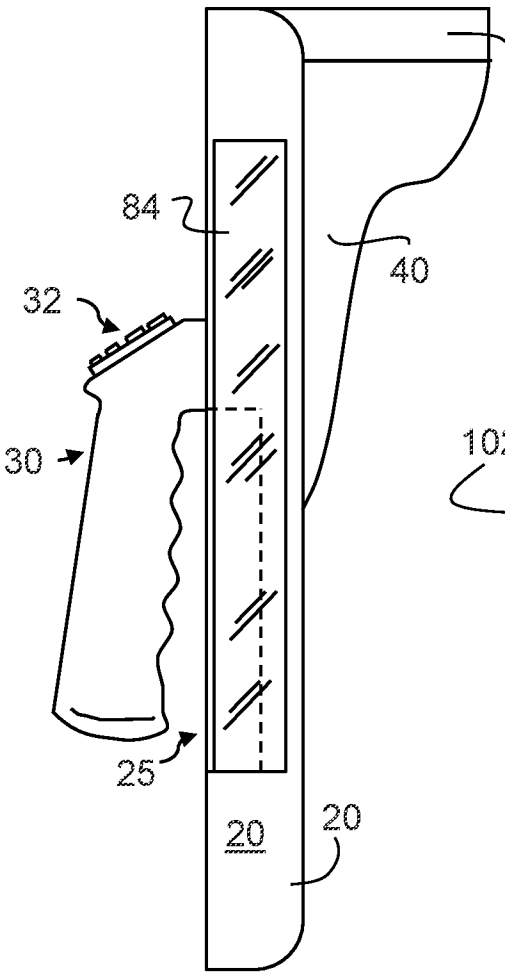
FIG. 10 shows a side view of a device according to an embodiment.

FIG. 10 shows a side view of an exemplary embodiment of the device 100. The device 100 includes a camera 102. The camera 102 is oriented along an axis substantially parallel to the emission direction of the lamp 10. In other embodiments, the camera 102 swivels in a camera mount that permits the camera 102 to be oriented along another axis that diverges from the emission direction of the lamp 10.

Figure 11:
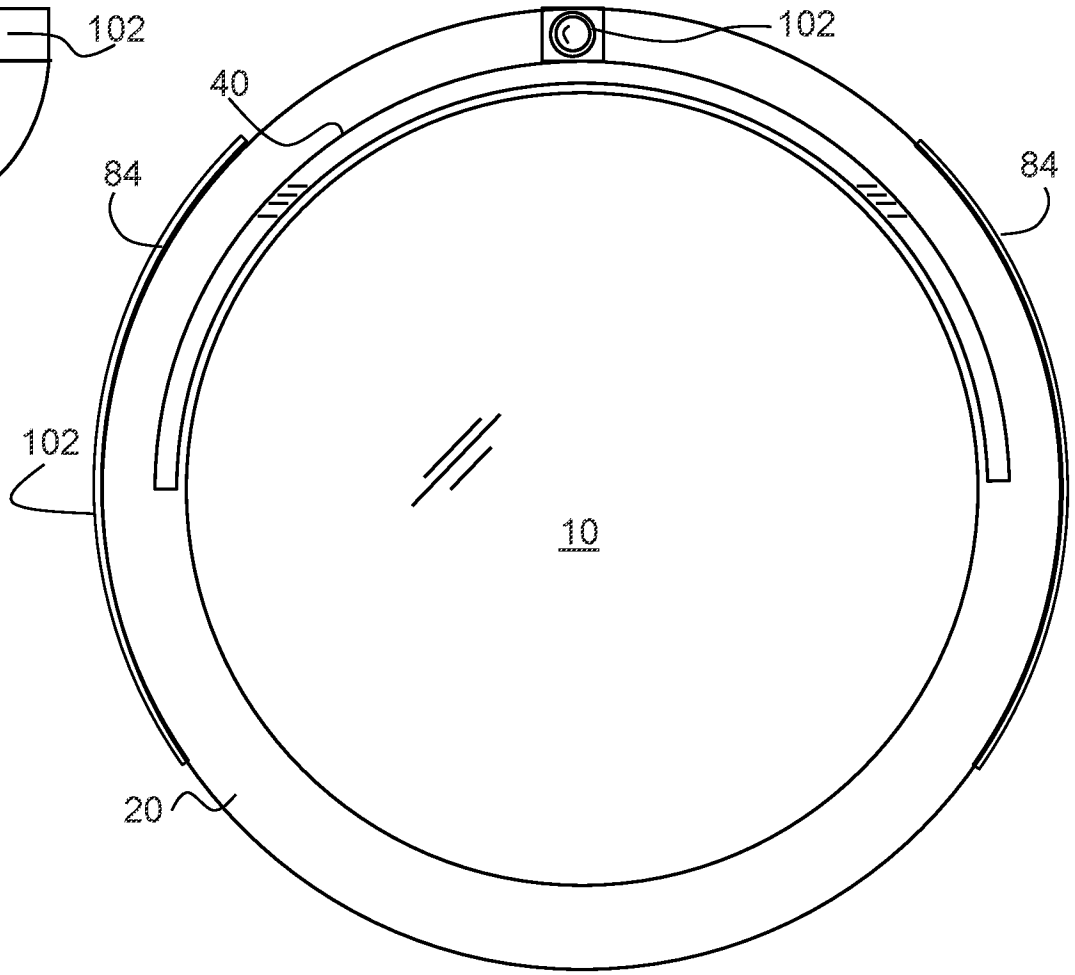
FIG. 11 shows a front view of the device of FIG. 10.

FIG. 11 shows a front view of the device 100 shown in FIG. 10. The camera 102 is mounted on top of the sun shield 40. However, in other embodiments, the camera 102 is mounted below the sun shield 40. In still other embodiments, the camera 102 is arranged integral to the sun shield 40. According to various embodiments, the camera 102 may be a digital camera including a sensor, for example a CCD or CMOS sensor. Some embodiments include a thermal imaging sensor or a night-vision sensor. The camera 102 may include a lens, such as a zoom lens, having focal elements to permit a clear image to be formed on a plane of the sensor. In one embodiment, the camera 102 is an HD video camera having a resolution of 1280 by 720 or 1920 by 1080. The camera 102 may be a 4K camera. The camera 102 may have a refresh rate of 30 frames-per-second (fps); from 24 to 120 frames fps; or from 60 to 240 fps. Other embodiments utilize a still camera.

Figure 12:
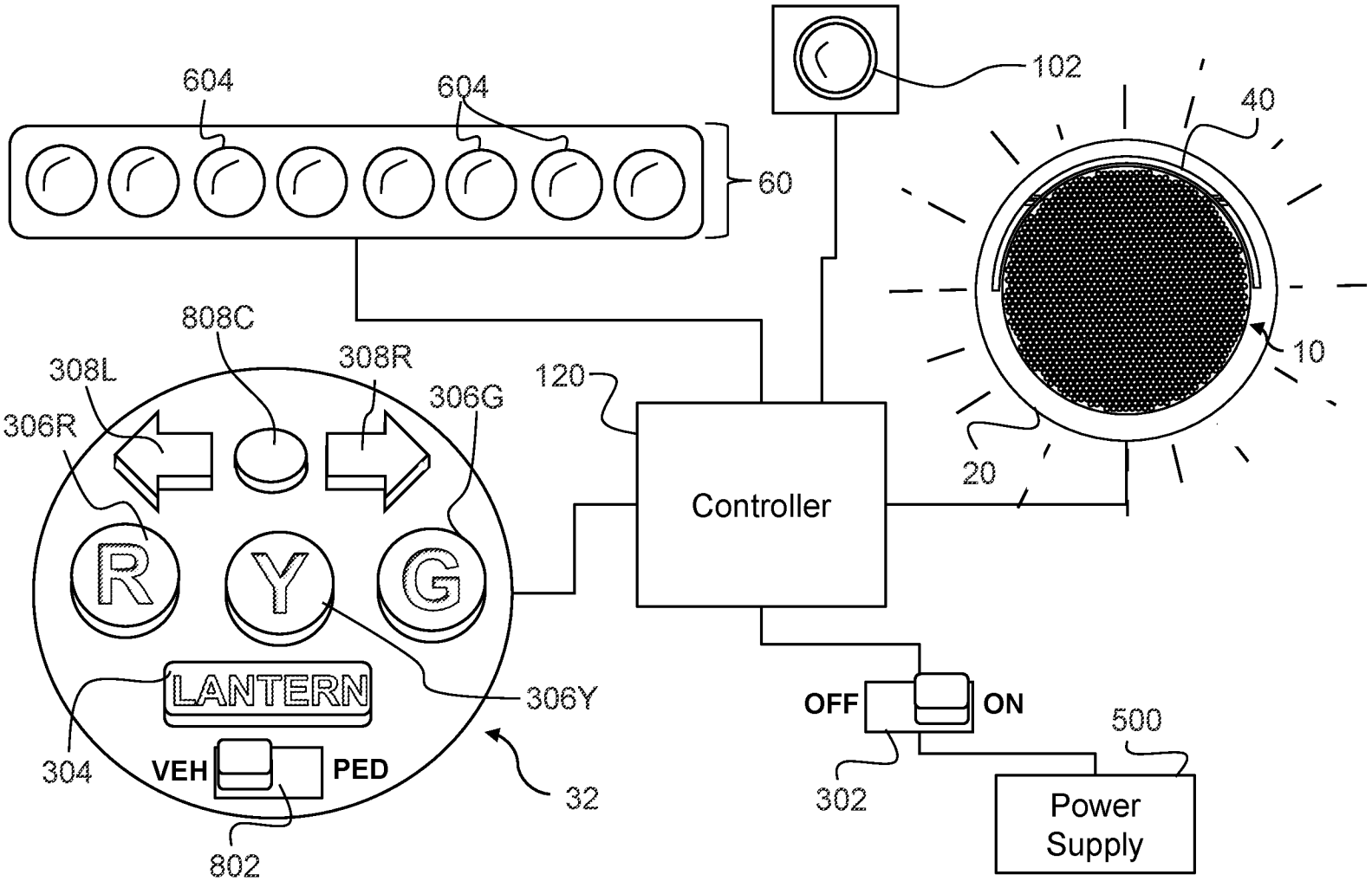
FIG. 12 shows a schematic view of a device according to an embodiment.

FIG. 12 shows a schematic view of the device 100 according to an embodiment. The power supply 500 provides electrical power via the power switch 302 to the controller 120, the lamp 10, the control panel 32, the feedback window 60, and the camera 102. The power switch 302 is switchable between an OFF position, where current is not permitted to flow, and an ON position where the electrical current is permitted to flow. In some embodiments, the power switch 302 is situated on the control panel 32. (See FIG. 6). In other embodiments, the power switch 302 is situated on a different portion of the device 100. For example, the power switch 302 may be situated on a bottom surface of the primary attachment portion 322. (See FIG. 9). In another embodiment, the power switch 302 is situated on a top surface of the primary attachment portion 322.

The camera 102 connects to the controller 120 such that images and/or video acquired by the camera 102 may be processed, stored, and/or communicated over a network to a remote device. (See FIGS. 13 and 14.) In some embodiments, the controller 120 includes a digital signal processor (DSP), a codec, and/or a graphics chip, to capture, encode, and/or compress images and/or video acquired by the camera 102.

In some embodiments, the controller 120 is configured to begin capturing video when the device 100 is powered on, and to cease capturing video when the device 100 is powered off. In other embodiments, the device 100 includes a button or selector operable to start and/or stop capturing video from the camera 102. In other embodiments, the camera is controlled exclusively from a remote device, such as a computer of a mobile device. (See FIGS. 13 and 14.)

The control panel 32 includes the lantern button 304, the red button 306R, the yellow button 306Y, the green button 306G, the left-hand arrow button 308L, and the right-hand arrow button 308R. The control panel 32 also includes a circle pattern button 808C and a signal mode selector 802. The circle pattern button 808C is operable to cause the lamp to display a pattern having a circular shape. For example, when either the left-hand arrow button 308L or the right-hand arrow button 308R is active, pressing the circle pattern button 808C causes the lamp to switch from showing an arrow to showing a circle.

The signal mode selector 802 is switchable between a VEH (vehicle) position and a PED (pedestrian) position. With the signal mode selector 802 in the VEHICLE position, the device 100 is configured to display signals appropriate for motor vehicles. With the signal mode selector 802 in the PEDESTRIAN position, the device 100 is configured to display signals appropriate for pedestrians. When a user manipulates any of the manual interface elements (302, 304, 306R, 306Y, 306G, 308L, 308R, 808C, 802), the controller 120 sets the lamp 10 to display a predetermined signal. Likewise, when a user manipulates any of the manual interface elements (302, 304, 306R, 306Y, 306G, 308L, 308R, 808C, 802), the controller 120 sets the feedback window 60 to display a response corresponding to the signal displayed by the lamp 10.

In some embodiments, the feedback window 60 includes a plurality of light-emitting diodes (LEDs) 604. For example, 8 LEDs arrayed in a single line between left and right-hand sides of the housing 20 are used in the embodiment shown in FIG. 12. Each of the LEDs 604 is an RGB LED, adaptable to emit light at varying wavelengths including, but not limited to, red, green, blue, yellow, and white. In other embodiments, other light sources are used in the feedback window 60. According to some embodiments, the feedback window 60 provides light whereby the manual interface elements (302, 304, 306R, 306Y, 306G, 308L, 308R, 808C, 802) are made visible to a user operating the device 100 in a dark environment. In other embodiments, the control panel 32 and/or one or more of the manual interface elements (302, 304, 306R, 306Y, 306G, 308L, 308R, 808C, 802) includes a backlight whereby such may be made visible to a user operating the device 100 in a dark environment.

Figure 13:
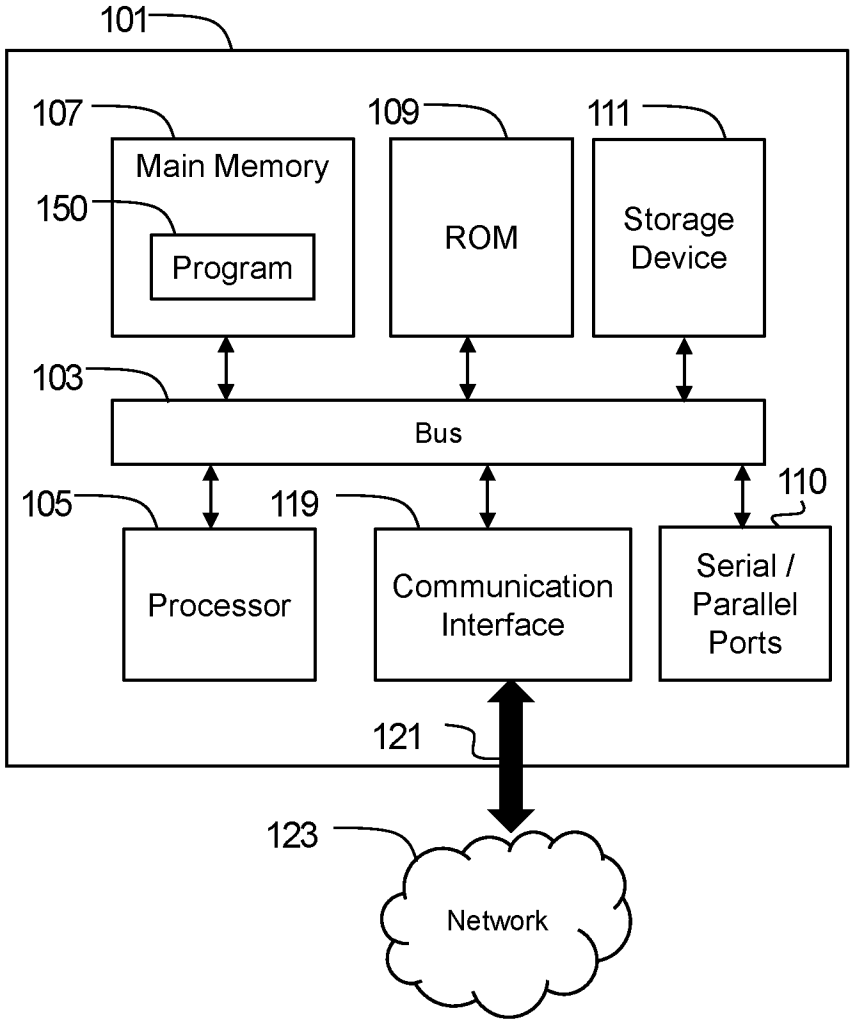
FIG. 13 shows a device according to an embodiment.

FIG. 13 shows an exemplary computer 101 consistent with systems and methods of the present disclosure. In some embodiments, the computer 101 serves as the controller 120 to translate a user's button presses, or other manipulations of the control panel 32, into changes in the signal displayed by the lamp 10. The computer 101 includes a bus 103 or other communication mechanism for communicating information and a processor 105 coupled with bus 103 for processing the information. The computer 101 also includes a main memory 107, such as a random access memory (RAM) or other dynamic storage device, coupled to the bus 103 for storing information and instructions to be executed by processor 105. In addition, the main memory 107 may be used for storing temporary variables or other intermediate information during execution of instructions to be executed by the processor 105. The main memory 107 includes a program 150 for implementing methods and systems consistent with the present disclosure. The computer 101 further includes a read-only memory (ROM) 109 or other static storage device coupled to the bus 103 for storing static information and instructions for the processor 105. Serial and/or parallel ports 110 are provided to the bus 103 for allowing various external devices to communicate with the computer 101. For example, where the controller 120 may use a serial and/or parallel port 110 to communicate with the camera 102. A storage device 111, such as a magnetic disk or optical disk, is provided and coupled to the bus 103 for storing information and instructions. The computer 101 may be a server, a personal computer, a mobile device such as a smartphone, a tablet, the device 100, or another computing device in various non-limiting embodiments.

According to one embodiment, the processor 105 executes one or more sequences of one or more instructions contained in the main memory 107. Such instructions may be read into the main memory 107 from another computer-readable medium, such as the storage device 111. Execution of the sequences of instructions in the main memory 107 causes the processor 105 to perform the process steps described herein. One or more processors in a multi-processing arrangement may also be employed to execute the sequences of instructions contained in the main memory 107. In alternative embodiments, hard-wired circuitry may be used in place of or in combination with software instructions. Thus, embodiments are not limited to any specific combination of hardware circuitry and software.

Although described relative to the main memory 107 and the storage device 111, instructions and other aspects of methods and systems consistent with the present disclosure may reside on another computer-readable medium, such as a floppy disk, a flexible disk, hard disk, flash drive, magnetic tape, a CD-ROM, magnetic, optical or physical medium, a RAM, a PROM, an EPROM, a FLASH-EPROM, any other memory chip or cartridge, or any other medium from which a computer can read, either now known or later discovered. In some embodiments, various parameters of the light source 402 (e.g., timing, intensity (brightness), color) are varied according to methods stored in a computer-readable medium.

The computer 101 also includes a communication interface 119 coupled to the bus 103. The communication interface 119 provides a two-way data communication coupling to a network link 121 that is connected to a network 123, such as the Internet or other computer network. Wireless links may also be implemented. In any such implementation, communication interface 119 sends and receives signals that carry digital data streams representing various types of information.

In one implementation, the computer 101 may operate as a web server on the computer network 123, for example, the Internet. The computer 101 may also represent other computers on the Internet, such as one or more users' computers, mobile devices, and/or smartphones having web browsers and the user's computers may have similar components as the computer 101.

Figure 14:
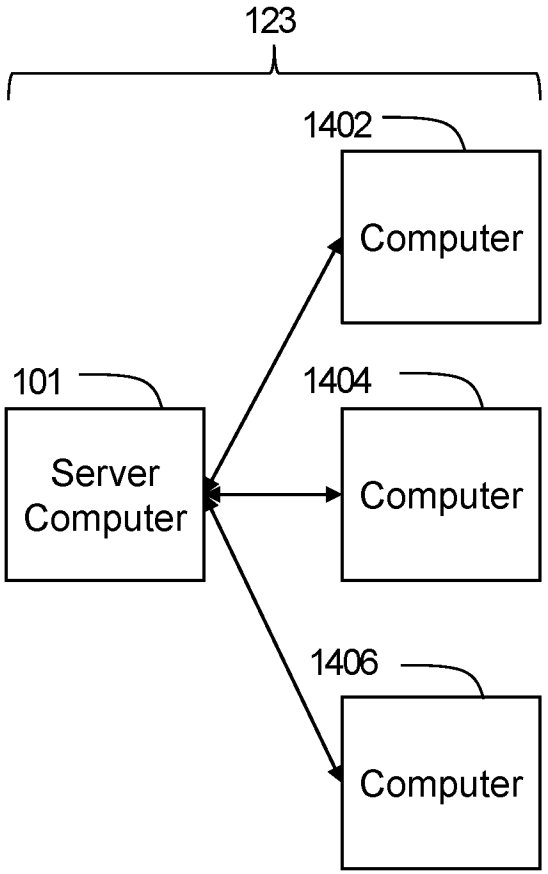
FIG. 14 shows a system according to an embodiment.

FIG. 14 shows the exemplary computer network 123 such as the Internet having a web server computer 101 for a website and computers (1402, 1404, 1406, etc.) used by various potential network participants. As described above, the computer 101 may be a server having the components described above and may implement methods and systems consistent with the present disclosure. The computers 1402, 1404, and 1406 may include web browsers and may be used by users to access the Internet or other network 123 and access the server computer 101. There may be any number of the user computers (1402, 1404, 1406, etc.) and any number of the server computers 101. Users of the computers 1402 through 1406, for example, may be users on the disclosed systems, including the device 100, by accessing the server computer 101. These computers 101 may be operated by these users.

Figure 15:
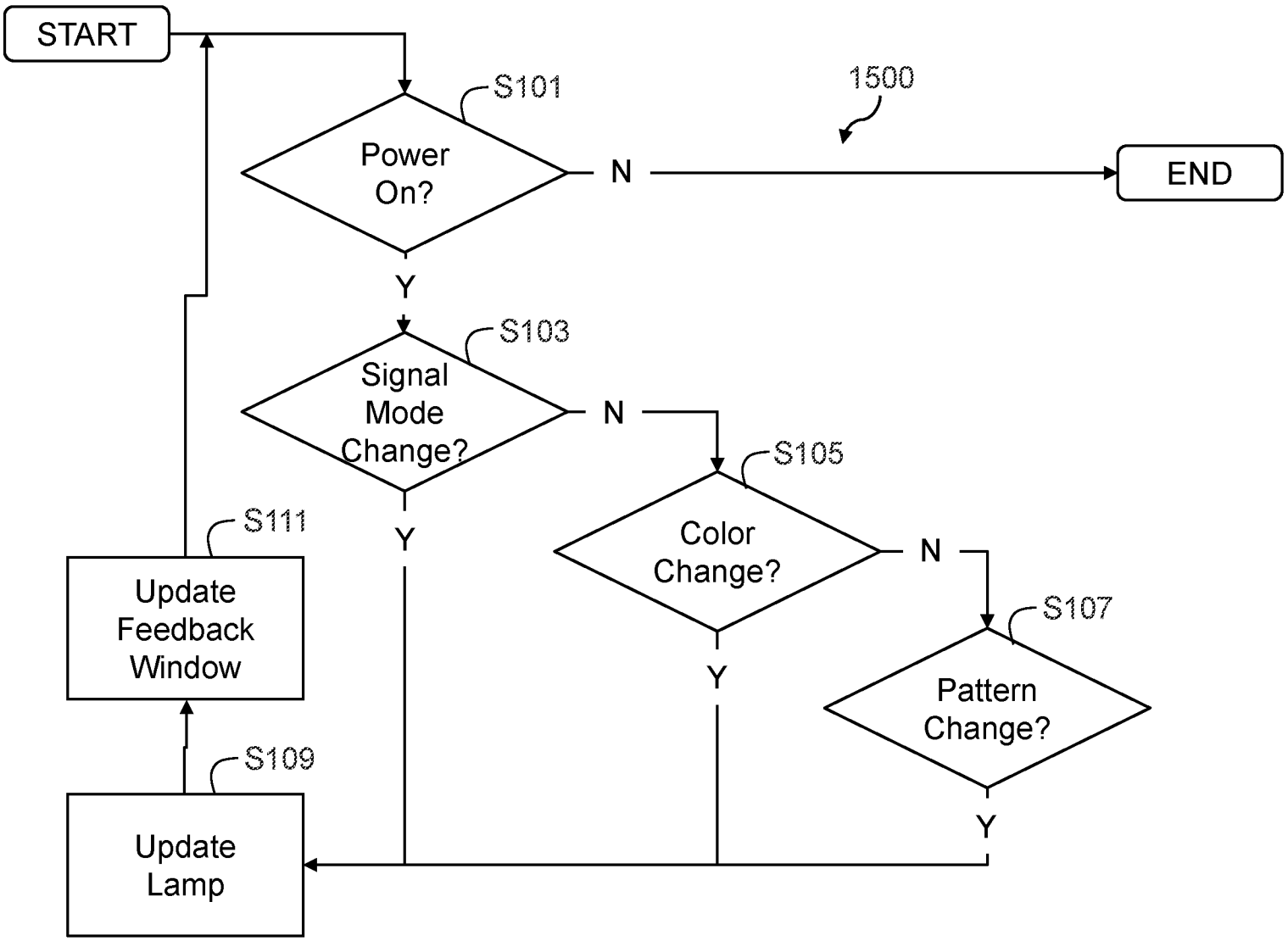
FIG. 15 shows a method according to an embodiment.

FIG. 15 shows a method according to an embodiment. The method is a control method 1500 for controlling the device 100 based on inputs received from a user. The control method 1500 starts by checking to see whether power is being supplied (step S101), i.e., in the form of an electrical current available at a predetermined voltage from the power supply 500. If the power is OFF, the control method 1500 ends. If the power is ON, the control method 1500 proceeds to step S103. So long as power is supplied, the control method 1500 operates as a continuous loop, returning to step S101 after completing the proceeding steps.

The control method 1500 checks to see whether a signal mode has changed (S103). If the signal mode has changed, i.e., since the last time the method 1500 encountered step S103, then the lamp 10 is updated (S109) and the feedback window 60 is updated (S111) in a manner corresponding to the change in signal mode. A change in signal mode may arise whenever a user switches the signal mode selector 802 from VEHICLE to PEDESTRIAN or vice versa. If the signal mode has not changed, then the method 1500 proceeds to step S105.

The control method 1500 checks to see whether a color has changed (S105). If the color has changed, i.e., since the last time the method 1500 encountered step S105, then the lamp 10 is updated (S109) and the feedback window 60 is updated (S111) in a manner corresponding to the change in color. A change in color may arise whenever a user presses one of the color buttons, e.g., lantern button 304, red button 306R, yellow button 306Y, or green button 306G. If the color has not changed, then the method 1500 proceeds to step S107.

The control method 1500 checks to see whether a pattern has changed (S107). If the pattern has changed, i.e., since the last time the method 1500 encountered step S107, then the lamp 10 is updated (S109) and the feedback window 60 is updated (S111) in a manner corresponding to the change in pattern. A change in patter may arise whenever a user presses one of the arrow buttons, e.g., left-hand arrow button 308L, or right-hand arrow button 308R. If the pattern has not changed, then the method 1500 proceeds to step S109. In other embodiments, the sequence of the steps S103 through S107 is rearranged and/or reversed.

At step S109, the control method 1500 instructs the lamp 10 to emit light in accordance with a predetermined signal for any combination of signal mode (VEHICLE or PEDESTRIAN), color (LANTERN, RED, YELLOW, or GREEN), and pattern (LEFT ARROW or RIGHT ARROW).

At step S111, the control method 1500 instructs the feedback window 60 to display a predetermined response for any of the predetermined signals emitted by the lamp 10. In other embodiments, the sequence of the steps S109 and S111 is reversed.

Having completed steps S103 through S111, the method 1500 returns to S101 and repeats.

Figure 16:
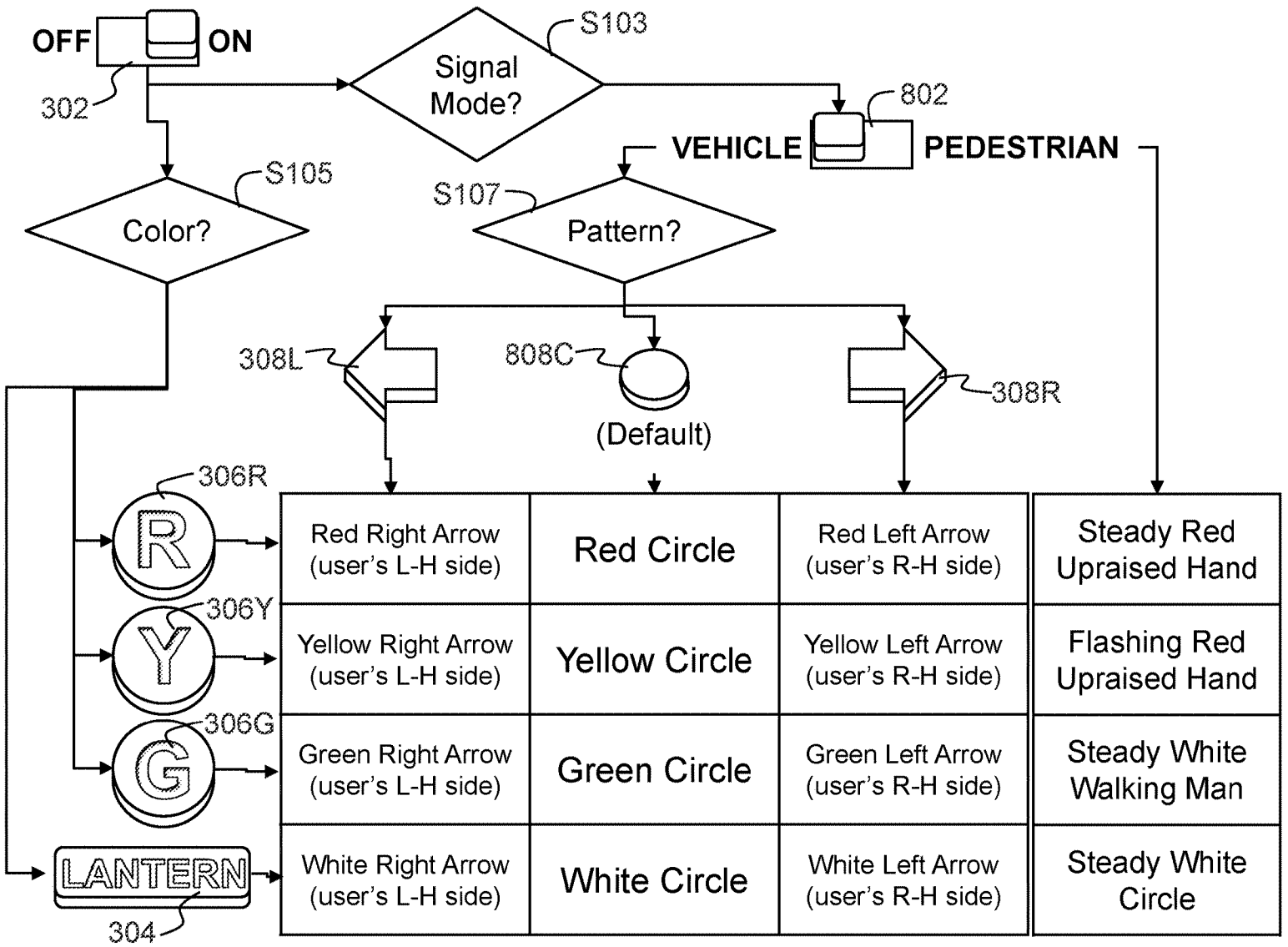
FIG. 16 shows a flowchart and resulting states for a method according to an embodiment.

FIG. 16 shows a flowchart and resulting states for a method according to an embodiment. FIG. 16 shows portions of the method 1500 of FIG. 15, further showing the predefined visual signals displayed by the lamp 10 resulting from various combinations of signal mode (S103), color (S105), and pattern (S107).

As shown in FIG. 16, the signal mode and the color can be varied independently. That is, for a given color, the lamp 10 has a corresponding signal, no matter whether the device 100 is in the vehicle mode (VEH at the step S103) or the pedestrian mode (PED at the step S103). More particularly, as shown in FIG. 16, when the device 100 is in the vehicle mode (VEH at the step S103), there is a default shape for the pattern (e.g., circle), such that pressing the lantern button 304 causes the lamp 10 to display a white circle, pressing the red button 306R causes the lamp 10 to display a red circle; pressing the yellow button 306Y causes the lamp 10 to display a yellow circle; and pressing the green button 306G causes the lamp 10 to display a green circle. In various embodiments, the default pattern can be any pattern or shape formable by the lamp 10. Likewise, in some embodiments, the device 100 has a default color, such that after the device 100 is turned on (S101), even before a particular color button is pressed, the lamp 10 will default to using its default color. The default color may be any color the lamp 10 can emit. In one embodiment, the default color is white. In another embodiment, the default color is red.

As shown in FIG. 16, when the device 100 is in the vehicle mode (VEH at the step S103), pressing the left-hand arrow button 308L causes the lamp 10 to display a RIGHT ARROW (pointing on the left-hand side, as viewed from the user's perspective), for any of the colors (RED, YELLOW, GREEN, or WHITE). When the device is in the vehicle mode (VEH at the step S103), pressing the right-hand arrow button 308R causes the lamp 10 to display a LEFT ARROW (pointing on the right-hand side, as viewed from the user's perspective), for any of the colors (RED, YELLOW, GREEN, or WHITE).

But as further shown in FIG. 16, when the device 100 is in the pedestrian mode (PED at the step S103), pressing the left-hand arrow button 308L and/or the right-hand arrow button 308R has no effect. This is because, according to the embodiment shown and described here, it is not sought to display left and right directional cues while in the pedestrian mode. Instead, when the device 100 is in the pedestrian mode (PED at the step S103), pressing the lantern button 304 causes the lamp to display a steady white circle, which may be useful as a general purpose torch or flashlight; pressing the red button 306R causes the lamp 10 to display a steady red upraised hand, signaling to pedestrians that it is unsafe to walk; pressing the yellow button 306Y causes the lamp 10 to display a flashing red upraised hand, signaling to pedestrians that if they are walking, they must proceed with caution; and pressing the green button 306G causes the lamp 10 to display a steady white walking person, signaling to pedestrians that it is safe to walk.

FIGS. 17 through 20B show correspondences between the manual interface elements, the feedback window 60, and the lamp 10 for the steps of the method 1500.

Figure 17:
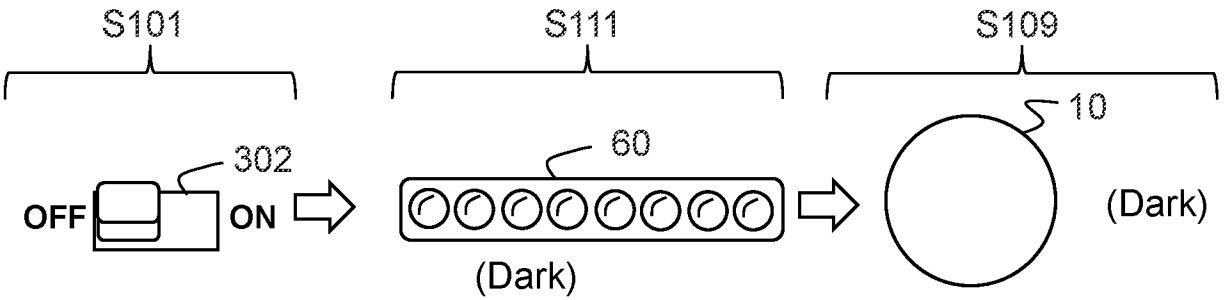
FIG. 17 shows aspects of a method according to an embodiment.

In FIG. 17, initially (step S101) if the power is OFF, then the feedback window 60 is dark and the lamp 10 is dark.

Figure 18:
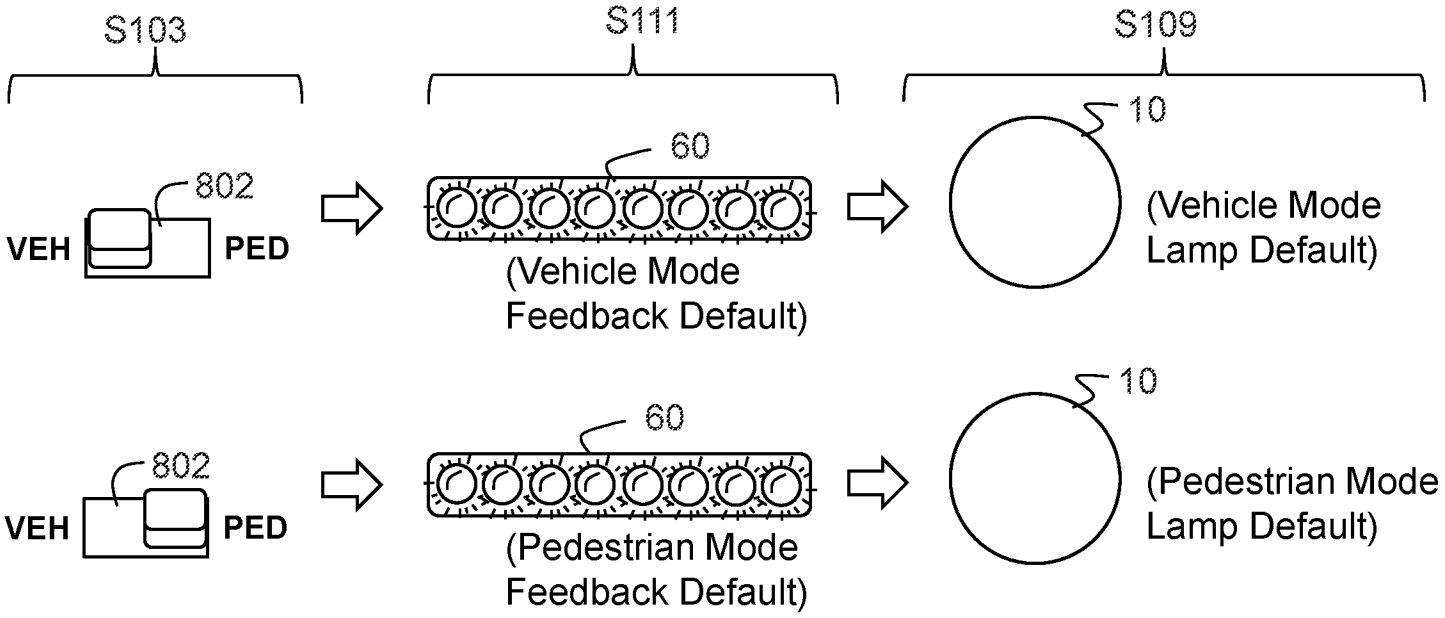
FIG. 18 shows aspects of a method according to an embodiment.

In FIG. 18, if the power is ON, and if (step S103) the signal mode is set to VEHICLE, where none of the color buttons (304, 306R, 306Y, 306G) has been pressed, then (step S111) the feedback window 60 shows a predetermined default indication for the vehicle mode and (step S109) the lamp 10 likewise displays a predetermined default signal for the vehicle mode. In one embodiment, for the vehicle mode, the window 60 has a default indication of solid green and the lamp 10 has a default signal of solid green. In other embodiments, the settings in effect immediately before the last power-off event (step S101) are stored as the defaults and retrieved the next time the device 100 is powered on. In still other embodiments, other defaults are used.

In FIG. 18, if the power is ON, and if (step S103) the signal mode is set to PEDESTRIAN, where none of the color buttons (304, 306R, 306Y, 306G) has been pressed, then (step S111) the feedback window 60 shows a predetermined default indication for the pedestrian mode and (step S109) the lamp 10 likewise displays a predetermined default signal for the pedestrian mode. In one embodiment, for the pedestrian mode, the window 60 has a default indication of solid white and the lamp 10 has a default signal of steady white. In other embodiments, the settings in effect immediately before the last power-off event (step S101) are stored as the defaults and retrieved the next time the device 100 is powered on. In still other embodiments, other defaults are used.

In FIG. 19, if (step S103) the signal mode is set to PEDESTRIAN and (step S105) the lantern button 304 is pressed, then (step S111) the feedback window 60 shows steady white and (step S109) the lamp 10 shows a steady white circle. In the pedestrian mode, if (step S105) the red button 306R is pressed, then (step S111) the feedback window 60 shows steady red and (step S109) the lamp 10 shows a steady red upraised hand. In the pedestrian mode, if (step S105) the yellow button 306Y is pressed, then (step S111) the feedback window 60 shows steady yellow and (step S109) the lamp 10 shows a flashing red upraised hand. In the pedestrian mode, if (step S105) the green button 306G is pressed, then (step S111) the feedback window 60 shows flashing white and (step S109) the lamp 10 shows a steady white walking person.

In FIG. 20A, if (step S103) the signal mode is set to VEHICLE and (step S105) the lantern button 304 is pressed, then (step S111) the feedback window 60 shows steady white and (step S109) the lamp 10 shows a steady white circle. In the vehicle mode, if (step S105) the red button 306R is pressed, then (step S111) the feedback window 60 shows steady red and (step S109) the lamp 10 shows a steady red circle. In the vehicle mode, if (step S105) the yellow button 306Y is pressed, then (step S111) the feedback window 60 shows steady yellow and (step S109) the lamp 10 shows a steady yellow circle. In the vehicle mode, if (step S105) the green button 306G is pressed, then (step S111) the feedback window 60 shows steady green and (step S109) the lamp 10 shows a steady green circle.

In FIG. 20B, if (step S103) the signal mode is set to VEHICLE and (step S105) the left-hand arrow button 308L is pressed, then (step S111) the feedback window 60 shows its left half (four LEDs) in the currently active color setting and its right half (the four remaining LEDs) is dark and (step S109) the lamp 10 shows a right turn arrow, with its point on the user's left-hand side). That is oncoming traffic will perceive the lamp 10 as showing a colored arrow pointing in the same direction as if the user (facing oncoming traffic) extended his or her left arm away from the body to direct the traffic to turn. In the vehicle mode, if (S107) the right-hand arrow button 308R is pressed, then (step S111) the feedback window 60 shows its right half (the four LEDs) in the currently active color setting and its left half (the four remaining LEDs) is dark and (step S109) the lamp 10 shows a left turn arrow, with its point the user's right-hand side). That is, oncoming traffic will perceive the lamp 10 as showing a colored arrow pointing in the same direction as if the user (facing oncoming traffic) extended his or her right arm away from the body to direct the traffic to turn.

Figure 21:
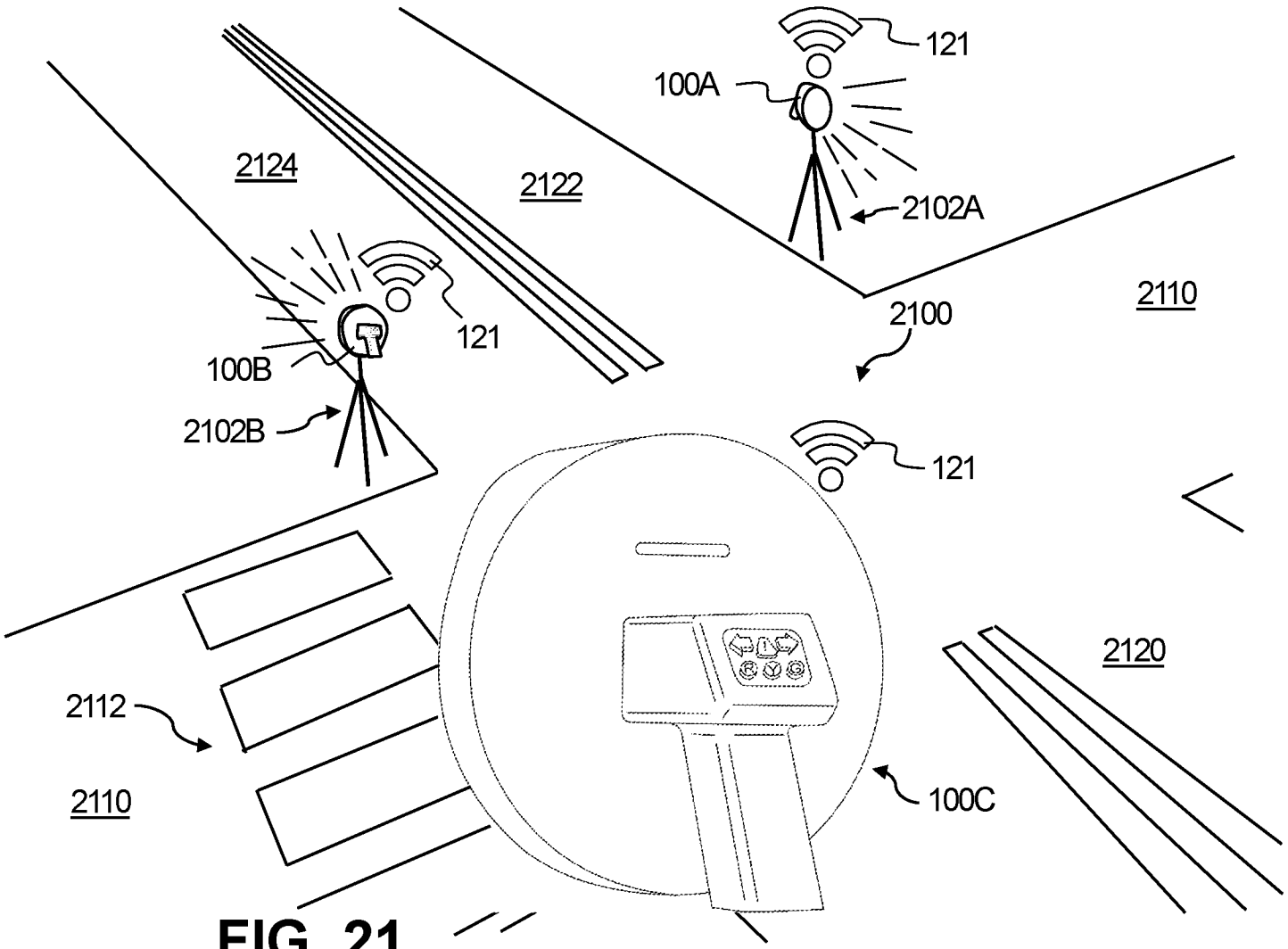
FIG. 21 shows a system according to an embodiment.

FIG. 21 shows a system including three (3) of the device 100 deployed at an intersection 2100. The intersection 2100 includes a road 2110 having a crosswalk 2112 and a second road 2120 having opposing travel lanes 2122 and 2124. At one corner of the road 2110 and the lane 2122 stands a first tripod 2102A on which is mounted a first device 100A. The first device 100A faces vehicular traffic approaching the intersection along the first lane 2122.

At a corner of the road 2110 and the lane 2124 stands a second tripod 2102B on which is mounted a second device 100B. The second device 100B faces vehicular traffic approaching the intersection along the second lane 2124 from a direction opposite the direction of the first lane 2122.

At a corner of the road 2110 and the lane 2124 opposite the second device 100B stands a user holding a third device 100C. The third device 100C faces pedestrian traffic approaching the crosswalk 2112 from the side of the road 2110 where the second device 100B is situated.

Each of the three devices (100A, 100B, 100C) includes a network link 121. In some embodiments, the network links 121 form an ad-hoc mesh network between the devices 100A, 100B, and 100C themselves. In other embodiments, the network links 121 connect the devices 100A, 100B, and 100C to a larger network 123, such as the Internet.

In some embodiments, the first and second devices (100A, 100B) are operated remotely by a user grasping the device 100C in his or her hand. For example, according to various embodiments, each of the devices 100A, 100B, 100C is configurable to receive and respond to commands transmitted from one or more of the other devices. Thus, in an embodiment, when the user manually operating the third device 100C changes a state of the third device 100C, the first and second devices 100A and 100B receive information regarding the change of the state of the third device 100C and are automatically updated in a manner appropriate for the arrangement of the first and second devices (100A, 100B) at the intersection 2100.

Figure 22:
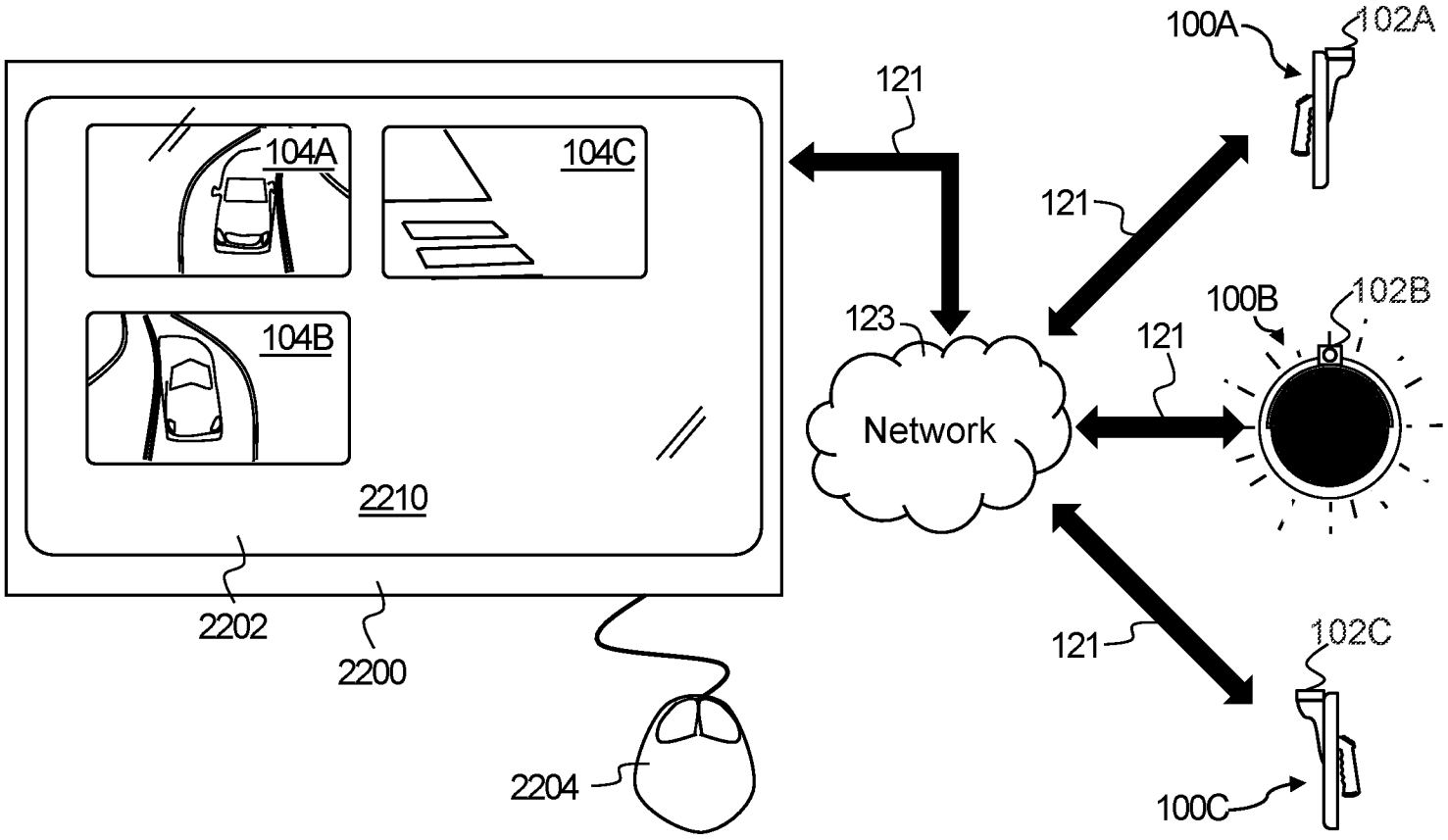
FIG. 22 shows a system according to an embodiment.

FIG. 22 shows a system including the system and devices of FIG. 21 and further including a headquarters device 2200. In some embodiments, the headquarters device is a computer, such as the computer 101. The headquarters device 2200 includes a network link 121, by which the headquarters device 2200 connects to one or more of the devices (100A, 100B, 100C), or any other number of the devices 100. In some embodiments, the headquarters device 2200 and the devices 100 connect via the network 123.

The headquarters device 2200 receives a live video stream 104 from the camera 102 in each of the connected devices 100. The headquarters device 2200 includes a display 2202. Video streams 104A, 104B, 104C corresponding to each of the connected devices 100A, 100B, 100C, are displayed in a graphical user interface (GUI) 2210 shown on the display 2202. In an embodiment, the GUI 2210 includes a grid or array of video streams 104. In other embodiments, the GUI 2210 includes other elements and arrangements. The headquarters device 2200 includes a human-interface device (HID) 2204 such as a mouse. A user of the headquarters device 2200 uses the HID 2204 to interact with the GUI 2210. In other embodiments, other human-machine paradigms are used.

Figure 23:
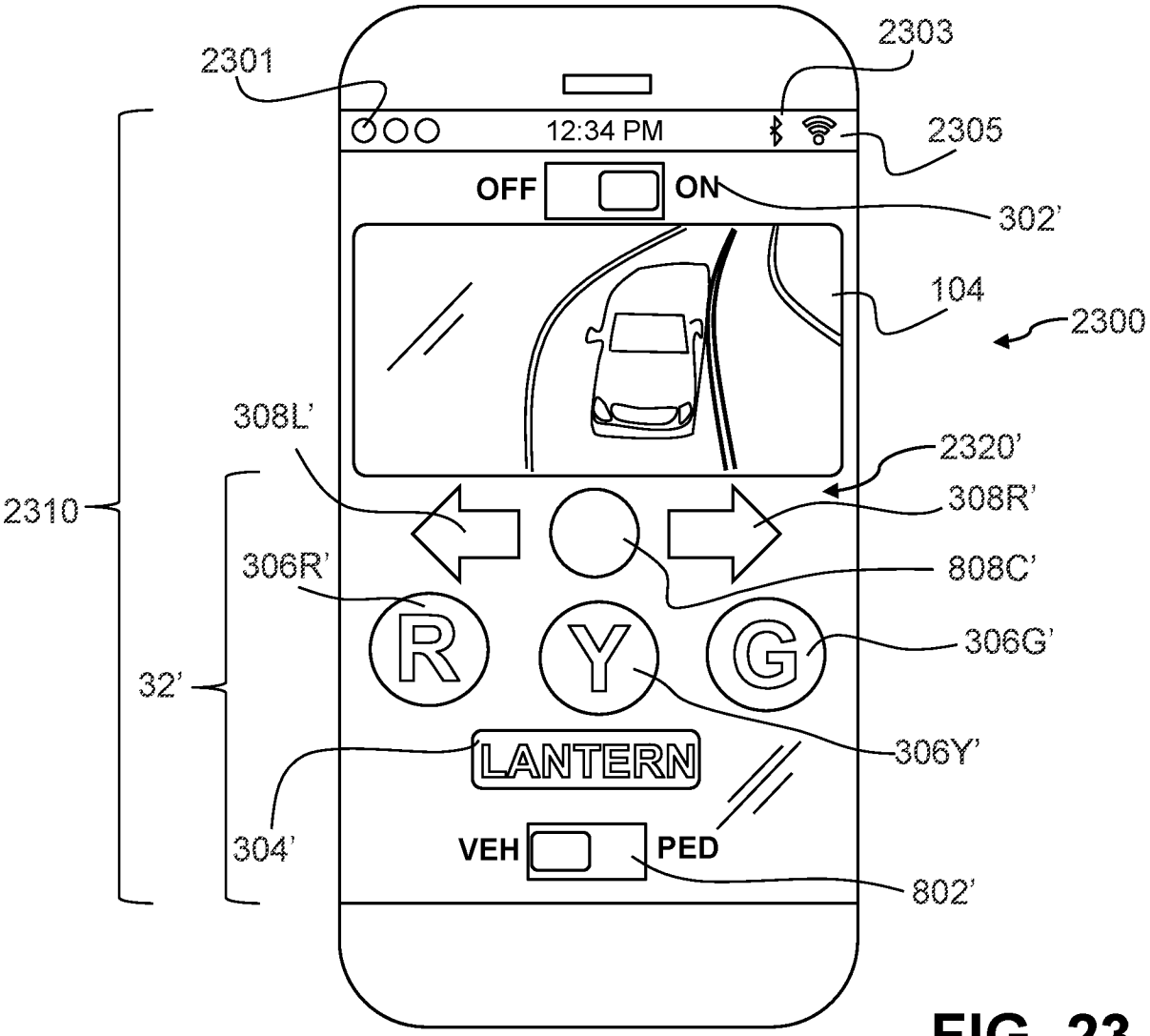
FIG. 23 shows a device according to an embodiment.

FIG. 23 shows a mobile device 2300. In some embodiments, the mobile device 2300 is a smartphone, a tablet, or the like. The mobile device 2300 includes a user interface (UI) 2310 accessible by a touch screen 2320. The UI 2310 includes status indicators reflecting various means of network connectivity, including cellular (2301), Bluetooth (2303), and Wi-Fi (2305). Each of these network connectivity means is a network link 121 connectable to one or more of the devices 100 and/or to the headquarters device 2200, either directly, or by the network 123. The UI displays a video stream 104 from a connected device 100.

The UI 2310 includes interactive touchscreen elements arranged in a software control panel 32' mimicking a physical size and layout of the control panel 32. For example, the software control panel 32' may include touchscreen interface elements 302', 304', 306R', 306Y', 306G', 308L', 308R', 808', 802' corresponding to each of the manual interface elements 302, 304, 306R, 306Y, 306G, 308L, 308R, 808, 802, respectively.

A user may control the connected device 100 by the software control panel 32' to remotely control the device 100 in a manner similar to the way the user would manually operate the device 100 using the control panel 32. For example, the software control panel 32' may permit operation of the device 100 using only the thumb of one or the other of the user's hands, the other fingers of the user's hand grasping the mobile device 2300. Moreover, the software control panel 32' can be used to operate the device 100 remotely. For example, the software control panel 32' can be used to operate the device from the safety and comfort of a user's vehicle, or from inside a building.

In some embodiments, the GUI 2210 and/or the mobile UI 2310 further include controls whereby the timing and other parameters of the operation of one or more of the remote devices 100 may be scheduled and/or automated.

Unless the context clearly dictates otherwise and where a range of values is provided, it is understood that each intervening value, to the tenth of the unit of the lower limit, between the upper and lower limit of that range, and any other stated or intervening value in that stated range is encompassed within the technology. The upper and lower limits of these intervening ranges, which may be independently included in the intervening ranges, are also encompassed within the technology, subject to any specifically excluded limit in the stated range. Where the stated range includes one or both of the limits, ranges excluding either or both of those included limits are also included in the technology.

Furthermore, where a value or values are stated herein as being implemented as part of the technology, it is understood that such values may be approximated, unless otherwise stated, and such values may be utilized to any suitable significant digit to the extent that a practical technical implementation may permit or require it.

Unless defined otherwise, all technical and scientific terms used herein have the same meaning as commonly understood by one of ordinary skill in the art to which this technology belongs. Although any methods and materials similar or equivalent to those described herein can also be used in the practice or testing of the present technology, a limited number of the exemplary methods and materials are described herein.

When a particular material is identified as being preferably used to construct a component, obvious alternative materials with similar properties may be used as a substitute. Furthermore, unless specified to the contrary, any and all components herein described are understood to be capable of being manufactured and, as such, may be manufactured together or separately.

It must be noted that as used herein and in the appended claims, the singular forms "a", "an", and "the" include their plural equivalents, unless the context clearly dictates otherwise.

All publications mentioned herein are incorporated by reference to disclose and describe the methods and/or materials which are the subject of those publications.

Moreover, in interpreting the disclosure, all terms should be interpreted in the broadest reasonable manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The subject headings used in the detailed description are included only for the ease of reference of the reader and should not be used to limit the subject matter found throughout the disclosure or the claims. The subject headings should not be used in construing the scope of the claims or the claim limitations.

Although the technology herein has been described with reference to particular embodiments, it is to be understood that these embodiments are merely illustrative of the principles and applications of the technology. In some instances, the terminology and symbols may imply specific details that are not required to practice the technology. For example, although the terms "first" and "second" may be used, unless otherwise specified, they are not intended to indicate any order but may be utilized to distinguish between distinct elements. Furthermore, although process steps in the methodologies may be described or illustrated in an order, such an ordering is not required. Those skilled in the art will recognize that such ordering may be modified and/or aspects thereof may be conducted concurrently or even synchronously.

It is therefore to be understood that numerous modifications may be made to the illustrative embodiments and that other arrangements may be devised without departing from the spirit and scope of the technology.

The invention claimed is:

1. A portable handheld traffic control device comprising:
a lamp;
a housing that encloses the lamp;
a handle attached to a proximal side of the housing, the handle including a control panel operable to control emission by the lamp of light on a distal side of the housing; and
a signal mode selector switchable between a first mode in which manual buttons of the control panel are configured to cause the lamp to display a first set of signals, and a second mode in which the manual buttons are configured to cause the lamp to display a second set of signals different from the first set,
wherein the first set of signals includes a first pattern, a second pattern different from the first pattern, and a third pattern different from the first and second patterns,
wherein the manual buttons of the control panel include a first pattern button operable to cause the lamp to emit light in the first pattern and a second pattern button operable to cause the lamp to emit light in the second pattern,
wherein the manual buttons of the control panel further include a first color button operable in the first mode to cause the lamp to emit light of a first color, and a second color button operable in the first mode to cause the lamp to emit light of a second color different from the first color,
wherein the control panel further includes a third color button operable in the first mode to cause the lamp to emit light of a third color different from the first and second colors, and
wherein the third color button is operable in the second mode to cause the lamp to display a third signal of the second mode,
the third signal of the second mode having at least one of
a color different from the third color of the first mode, and
a shape different from the first, second, and third patterns of the first mode.

2. A portable handheld traffic control device comprising:
a lamp;
a housing that encloses the lamp;
a handle attached to a proximal side of the housing, the handle including a control panel operable to control emission by the lamp of light on a distal side of the housing; and
a signal mode selector switchable between a first mode in which manual buttons of the control panel are configured to cause the lamp to display a first set of signals, and a second mode in which the manual buttons are configured to cause the lamp to display a second set of signals different from the first set,
wherein the second set of signals includes a steady red upraised hand; a flashing red upraised hand; and a steady white walking person.

3. A system comprising:
a computer; and
a portable handheld traffic control device comprising
a lamp;
a housing that encloses the lamp;
a handle attached to a proximal side of the housing, the handle including a control panel operable to control emission by the lamp of light on a distal side of the housing; and
a signal mode selector switchable between a first mode in which manual buttons of the control panel are configured to cause the lamp to display a first set of signals, and a second mode in which the manual buttons are configured to cause the lamp to display a second set of signals different from the first set,
the device being configured to communicate with the computer, the device further including a video camera fixed to the housing, and the computer having a user interface configured to display a video stream received from the video camera.

4. The system of claim 3, wherein the user interface includes a software control panel operable to remotely control the user interface of the portable handheld traffic control device, the software control panel having a first color button, a second color button, a third color button, a first pattern button, and a second pattern button,
the first, second, and third color buttons arrayed between right and left-hand sides of the control panel, and
the first and second pattern buttons arrayed above the first, second, and third color buttons and extending between right and left-hand sides of the control panel.

* * * * *